US010394163B2

(12) United States Patent
Zhou et al.

(10) Patent No.: US 10,394,163 B2
(45) Date of Patent: Aug. 27, 2019

(54) TONER CARTRIDGE WITH A TONER SWITCH ASSEMBLY

(71) Applicant: Ninestar Corporation, Zhuhai (CN)

(72) Inventors: Wenchang Zhou, Zhuhai (CN); Wanhong Huang, Zhuhai (CN)

(73) Assignee: APEX TECHNOLOGY CO., LTD., Zhuhai (CN)

( * ) Notice: Subject to any disclaimer, the term of this patent is extended or adjusted under 35 U.S.C. 154(b) by 0 days.

(21) Appl. No.: 15/835,080

(22) Filed: Dec. 7, 2017

(65) Prior Publication Data

US 2018/0095381 A1 Apr. 5, 2018

Related U.S. Application Data

(63) Continuation of application No. 15/211,925, filed on Jul. 15, 2016, now Pat. No. 9,869,949, which is a continuation of application No. PCT/CN2014/081802, filed on Jul. 8, 2014.

(30) Foreign Application Priority Data

Jan. 20, 2014 (CN) ..... 2014 2 0035561 U
Nov. 5, 2015 (CN) ..... 2015 1 0753466

(51) Int. Cl.
*G03G 15/08* (2006.01)

(52) U.S. Cl.
CPC ..... *G03G 15/0886* (2013.01)

(58) Field of Classification Search
CPC ..... G03G 2215/0692; G03G 2215/1612
See application file for complete search history.

(56) References Cited

U.S. PATENT DOCUMENTS

| | | | | |
|---|---|---|---|---|
| 5,153,649 | A | 10/1992 | Park | |
| 5,678,121 | A | 10/1997 | Meetze, Jr. et al. | |
| 5,722,014 | A | 2/1998 | Fike | |
| 5,734,953 | A | 3/1998 | Tatsumi | |
| 5,828,935 | A * | 10/1998 | Tatsumi | G03G 15/0868 399/260 |
| 7,848,684 | B2 | 12/2010 | Kawai | |
| 2007/0196136 | A1 | 8/2007 | Yamamoto et al. | |
| 2009/0158667 | A1 | 6/2009 | Yoshizawa et al. | |
| 2010/0178080 | A1 | 7/2010 | Huang | |
| 2012/0114389 | A1 | 5/2012 | Tsumita | |
| 2013/0078004 | A1 | 3/2013 | Matsumoto | |

FOREIGN PATENT DOCUMENTS

| | | | |
|---|---|---|---|
| CN | 1152138 | A | 6/1997 |
| CN | 201215610 | Y | 4/2009 |
| CN | 201262686 | Y | 6/2009 |
| CN | 102467019 | A | 5/2012 |
| CN | 203673229 | U | 6/2014 |
| EP | 2369425 | A1 | 9/2011 |
| JP | 2005107141 | A | 4/2005 |

* cited by examiner

*Primary Examiner* — Victor Verbitsky
(74) *Attorney, Agent, or Firm* — Anova Law Group, PLLC

(57) ABSTRACT

A toner cartridge is provided. The toner cartridge can be removably mounted on an imaging device. The toner cartridge includes a housing with a toner storage; a toner outlet aligned with a toner inlet on the imaging device; and a switch assembly disposed between the toner outlet and the toner inlet and controlling toner in the toner cartridge to flow from the toner outlet into the toner inlet. The switch assembly slides between a first position to open the toner outlet and a second position to close the toner outlet.

19 Claims, 24 Drawing Sheets

TONER CARTRIDGE WITH A TONER SWITCH ASSEMBLY

CROSS-REFERENCES TO RELATED APPLICATIONS

This application a continuation of U.S. patent application Ser. No. 15/11,925, filed on Jul. 15, 2016, which claims priority of Chinese Application No. 201510753466.3, filed on Nov. 5, 2015, and of International Patent Application No. PCT/CN2014/081802, filed on Jul. 8, 2014, which claims priority of Chinese Application No. 201420035561.0, filed on Jan. 20, 2014, and the entire contents of all of above applications are hereby incorporated by reference.

FIELD OF THE INVENTION

The present disclosure generally relates to the field of printing technologies and, more particularly, relates to a toner cartridge.

BACKGROUND

An imaging device can utilize toner to form images on a piece of printing paper. The toner can be contained in a toner cartridge removably mounted in the imaging device. When the toner in the toner cartridge runs out, a new toner cartridge can be used to replace the run-out toner cartridge.

As shown in FIG. 1, the imaging device 180 and the toner cartridge 100 is removably mounted in a laser printer. In general, the imaging device 180 is installed first and, then, the toner cartridge 100 is installed. The toner cartridge 100 can also be removably mounted on imaging device 180. When the toner cartridge is mounted on the imaging device, the toner outlet 152 on the toner cartridge is aligned and matches with the toner inlet 188 of the imaging device, such that toner can flow from the toner outlet 152 to the toner inlet 188. The arrow shown in FIG. 1 illustrates the direction in which the toner cartridge 100 is mounted on the imaging device 180 (i.e., the x-direction).

As shown in FIGS. 2A and 2B, a switch member 170 is disposed on the toner outlet 150 of the toner cartridge 100, for opening or closing the toner outlet 152. The switch member 170 is connected to the toner cartridge 100 through a rotating shaft 402 and, the switch member 170 can rotate around the rotating shaft 402. A torsion spring (not shown) is installed on the rotating shaft 402, one free end of the torsion spring abuts the switch member 170, and the other free end of the torsion spring abuts a front wall 114 of the toner cartridge 100, such that the switch member 170 is in closed position (FIG. 2A) when in a normal state.

On the distal end of the switch member 170, there is also provided with a force receiving portion 406. The force receiving portion 406 is entirely bent downward, contacting the side rib 189 of the toner inlet 188 of the imaging device 180, so as to open the switch member 170. When the toner cartridge 100 is inserted into the imaging device 180, before the end of the force receiving portion 406 of the switch member 170 contacts with the side rib 189, the switch member 170 is in the closed position, as shown in FIG. 2A.

When the force receiving portion 406 of the switch member 170 is in contact with the side rib 189, the switch member 170 overcomes the torque of the torsion spring on the rotating shaft 402 and rotates downward, and the switch member 170 is in an open position, as shown in FIG. 2B. The toner outlet 152 connects with the toner inlet 188 of the imaging device, and the toner moves from the toner cartridge 100 into the imaging device 180, participating in the development process of the images.

During the process of opening the toner outlet 152 of the toner cartridge by the switch member 170, if there is toner leakage, because the switch member can have an angle with the toner outlet when rotating to the open position, the toner can slide down from the toner outlet 152 along the tilted switch member to places in the imaging device that are not corresponding to the toner outlet. Thus, the places not corresponding to the toner outlet may be contaminated.

Further, during the process of opening the toner outlet 152 of the toner cartridge by the switch member 170, the toner outlet 152 may be opened before the toner outlet 152 is completely aligned with the toner inlet 188 of the imaging device, and toner can leak from the toner outlet 152 into the imaging device and contaminate the imaging device, resulting in printing defects as well as waste of toner.

The disclosed toner cartridges and methods are directed to solve one or more problems set forth above and other problems.

BRIEF SUMMARY OF THE DISCLOSURE

One aspect of the present disclosure includes a toner cartridge. The toner cartridge can be removably mounted on an imaging device. The toner cartridge includes a housing with a toner storage; a toner outlet aligned with a toner inlet on the imaging device; and a switch assembly disposed between the toner outlet and the toner inlet and controlling toner in the toner cartridge to flow from the toner outlet into the toner inlet. The switch assembly slides between a first position to open the toner outlet and a second position to close the toner outlet.

Another aspect of the present disclosure includes a toner cartridge. The toner cartridge can be removably mounted on an imaging device. The toner cartridge includes a housing with a toner storage; a cylindrical toner transport portion to transfer toner in the toner storage; a toner outlet disposed on the cylindrical toner transport portion and aligned with a toner inlet on the imaging device; and a cylindrical switch assembly matching the cylindrical toner transport portion and controlling the toner in the toner storage to flow from the toner outlet into the toner inlet. The switch assembly slides between a first position to open the toner outlet and a second position to close the toner outlet.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the disclosure, which are illustrated in the accompanying drawings. Wherever possible, the same reference numbers will be used throughout the drawings to refer to the same or like parts.

To facilitate the description, the direction "x" refers to the forward direction of the toner cartridge, the direction "y" refers to the up direction of the toner cartridge, and the direction "z" refers to the right direction of the toner cartridge. The direction of "x" is also the installation direction of the toner cartridge into an imaging device.

First Embodiment

Figure 3:
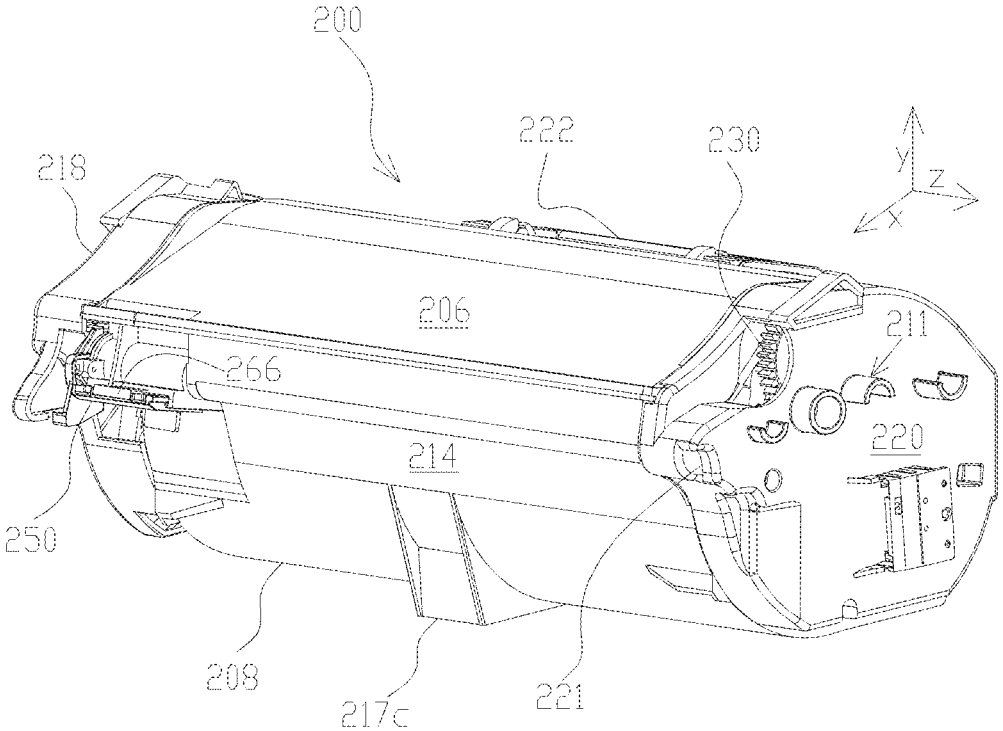
FIG. 3 is a front perspective view of an exemplary toner cartridge according to disclosed embodiments.
Figure 4:
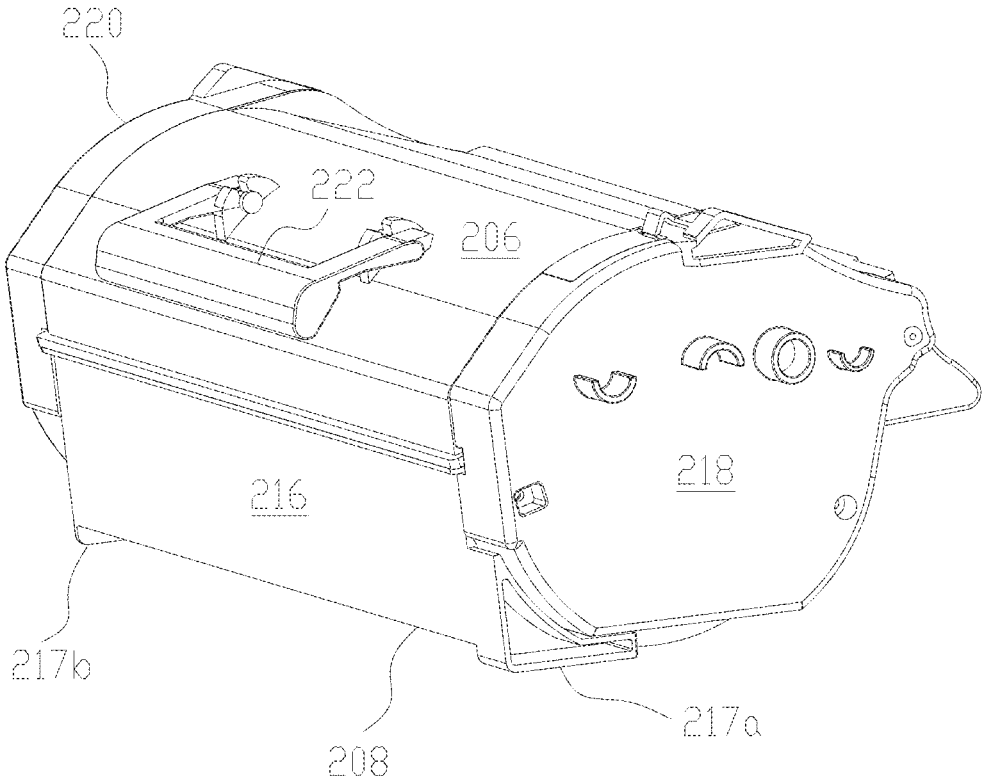
FIG. 4 is a rear perspective view of an exemplary toner cartridge according to disclosed embodiments.
Figure 5:
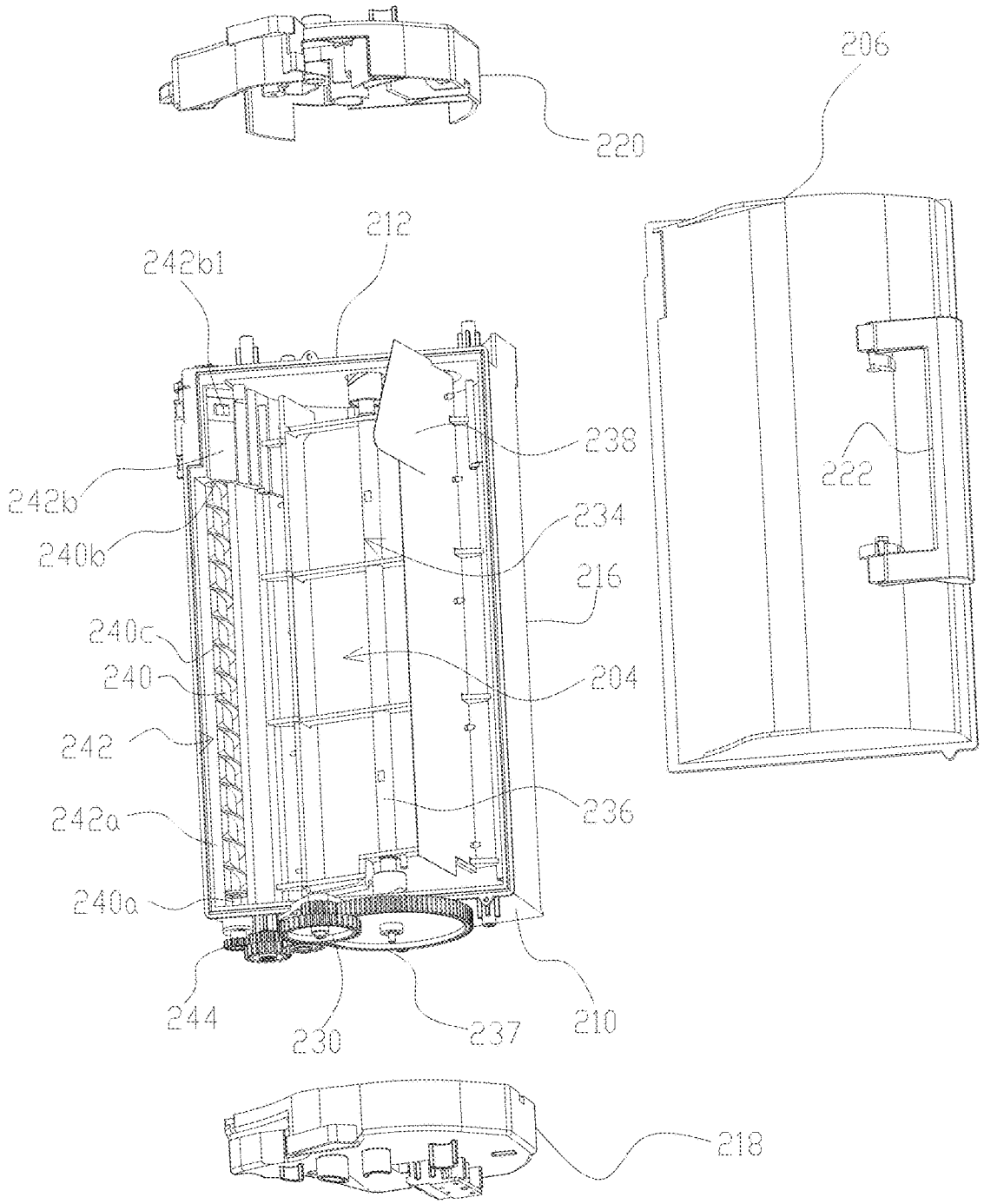
FIG. 5 is an exploded perspective view of an exemplary toner cartridge according to disclosed embodiments.

Referring to FIGS. 3-5, the toner cartridge 200 includes a housing, and the housing is provided with a toner storage 204 (FIG. 5). The housing includes a top cover 206 and a body 208. The top cover 206 and the body 208 can be welded together to form an enclosed toner storage 204.

The body 208 includes a first sidewall 210 and a second sidewall 212, which are connected with adjacent front wall 214 and rear wall 216. A first side cover 218 and a second side cover 220 are attached to the first sidewall 210 and second sidewall 212 by screws or other fastening means. A recessed cartridge stopper groove 221 can be configured on the second side cover 220 in the direction from the front wall 214 to the rear wall 216. A handle 222 can also be disposed on the top cover 206 or the body 208 of the toner cartridge 200, facilitating the toner cartridge 200 to be removed from or installed into the imaging device.

Figure 12:
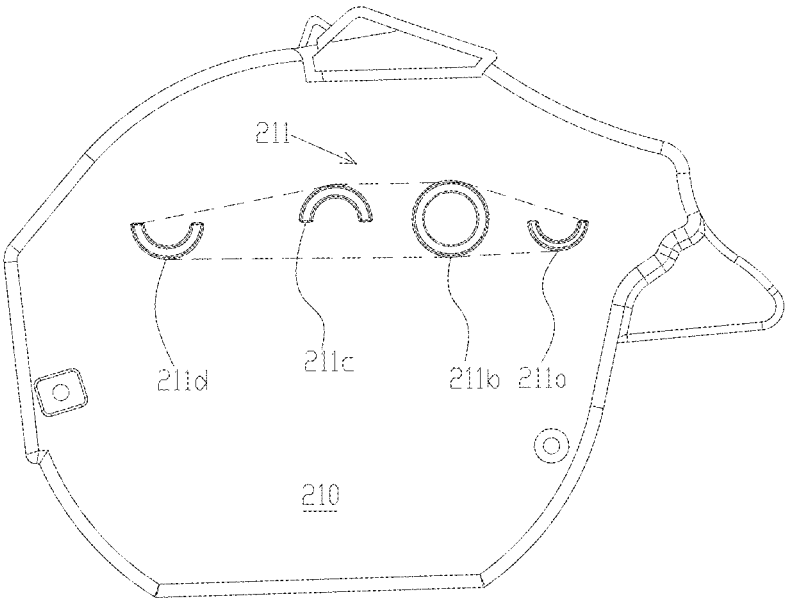
FIG. 12 is a front view of one end cover of a toner cartridge is a partial sectional view of a toner cartridge installed in the printer according to disclosed embodiments.

Referring to FIGS. 3, 4 and 12, the first side cover 218 and the second side cover 220 are provided with wing-shaped cartridge mounting rails 211. When the toner cartridge 200 is being installed into the printer, the wing-shaped cartridge mounting rails 211 on the toner cartridge 200 slide in the grooves (not shown) on the inner wall of the printer, so as to install the toner cartridge into the specified location in the printer.

Referring to FIG. 12, the wing-shaped cartridge mounting rails 211 includes a plurality of protrusions 211*a*, 211*b*, 211*c*, and 211*d*. The outer contour of the protrusions 211*a*, 211*b*, 211*c*, and 211*d* (shown in dotted lines in FIG. 12) extends from the front wall 214 of the toner cartridge 220 to the rear wall 216, with the front portion (the segment with 211*a*) narrower than the rear portion (the segment with 211*b*, 211*c*, and 211*d*). Thus, it may be easy to guide the toner cartridge 200.

The protrusions 211*a*, 211*c*, and 211*d* may have a semi-circular cross-section, and the protrusion 211*b* may have a circular cross-section. The bottom circle tangent of the protrusions 211*a*, 211*b*, and 211*d* is connected at the same horizontal line. By using a plurality of portions (protrusions 211*a*, 211*b*, 211*c*, and 211*d*) to form the cartridge mounting rail, on one hand it can save material, and on the other hand it can solve the side-cover deformation issue caused by injection molding shrinkage. Other shapes and number of the protrusions can also be used.

Referring to FIG. 5, a gear assembly is arranged between the first side cover 218 and the first side wall 210. A main gear 230 can be engaged with a driving device in the laser printer to transmit driving power. At the distal end of the toner cartridge 200, a portion of the main gear 230 is exposed between the first side cover 218 and the first side wall 210 (FIG. 3).

Stirring member 234 is rotatably mounted in the toner storage 204. The two ends of the rotating shaft 236 of the stirring member 234 pass through the first sidewall 210 and the second sidewall 212 via matching shaft bores on the first sidewall 210 and the second sidewall 212, respectively. The drive gear 237, connecting with the first end of the rotating shaft 236, engages with the main gear 230 to transmit driving power.

Referring to FIG. 5, the toner feeding screw or auger 240 includes a first end portion 240*a*, a second end portion 240*b*, and a threaded portion 240*c*. The front wall 214 has a channel 242 along the 'z' direction between the first side wall 210 and the second side wall 212. The channel 242 and the rotary axis of the toner feeding auger 240 are above the rotating shaft 235 of the stirring member. The channel 242 may be a part of the front wall 214 and may be injection-molded together with the front wall 214.

The first end portion 240*a* of the toner feeding auger 240 extends through the first side wall 210, and the drive gear 244 is mounted on the first end portion 240*a* of the toner feeding auger 240, engaging the main gear 230 directly or through one or more intermediate gears.

The channel 242 includes an open portion 242*a* and a closed portion 242*b*. The open portion 242*a* of the channel 242 is open to the toner storage 204, and extends in the direction from the first side wall 210 to the second end portion 240*b* of the toner feeding auger 240 (the left direction of the toner cartridge). The closed portion 242*b* of the channel 242 extends from the second side wall 212 (the right direction of the toner cartridge), and encloses the second end portion 240*b* of the toner feeding auger 240.

When the stirring member 234 is rotated, the stirring blade 238 installed on the stirring member 234 transfers toner from the toner storage 204 into the open portion 242*a* of the channel 242. The toner feeding auger 240 is rotated by the drive gear 244, transferring the toner in the channel 242 to the closed portion 242*b* of the channel 242. The toner outlet 252 (FIG. 7, 8, 10, or 11) is located at the bottom of the closed portion 242*b* of the channel 242. The toner outlet 252 faces downward, such that the toner can flow out of the toner outlet 252 with the help of gravity.

The switch member 250 (FIG. 6) is provided on the on the toner outlet 252 and the front wall 214. The switch member 250 can open or close the toner outlet 252, so as to control the flow of the toner from the toner cartridge 200. The closed portion 242*b* of the channel 242 can also be provided with one or more ventilation windows 242*b*1, such that air outside the toner cartridge can be introduced into the toner storage 204 via the toner outlet 252 and the ventilation windows 242*b*1, releasing the pressure inside the toner storage 204.

Figure 6:
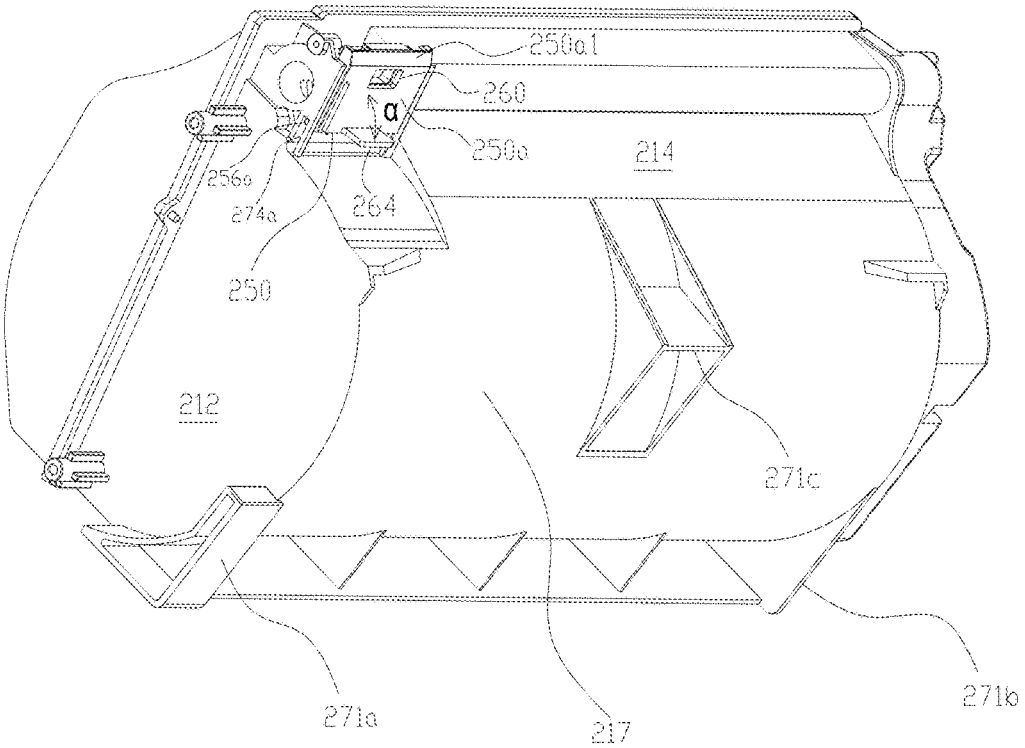
FIG. 6 is a perspective view of an exemplary toner cartridge with the switch member according to disclosed embodiments.
Figure 7:
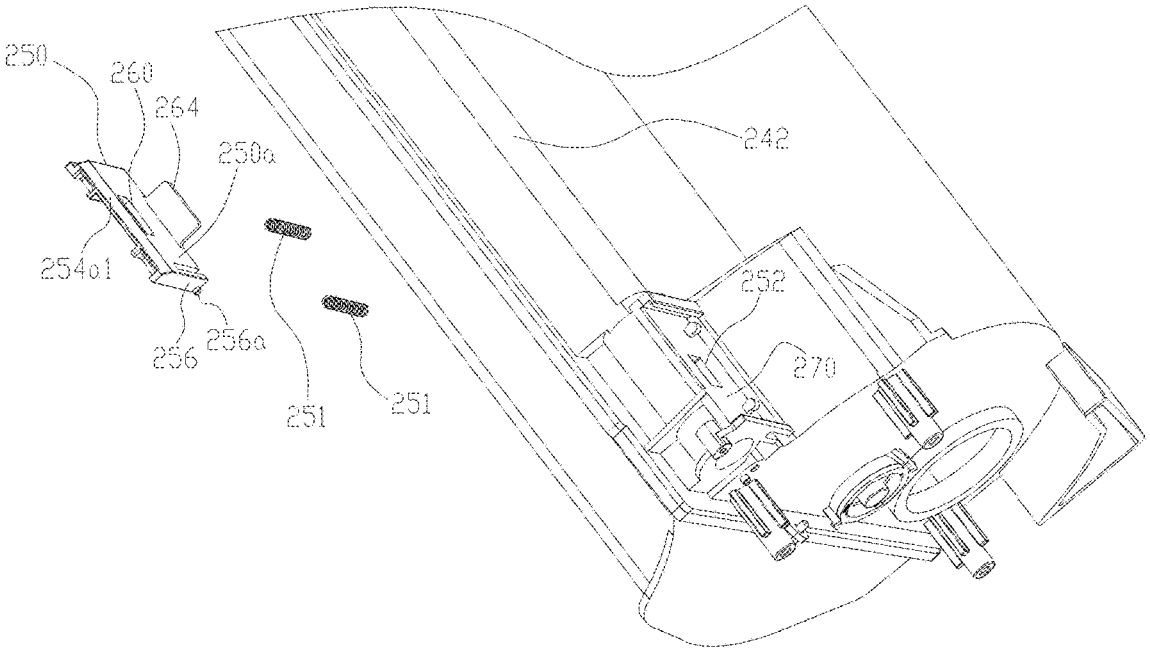
FIG. 7 is an exploded perspective view of a switch member, a compression spring, and the toner cartridge of one embodiment.
Figure 9:
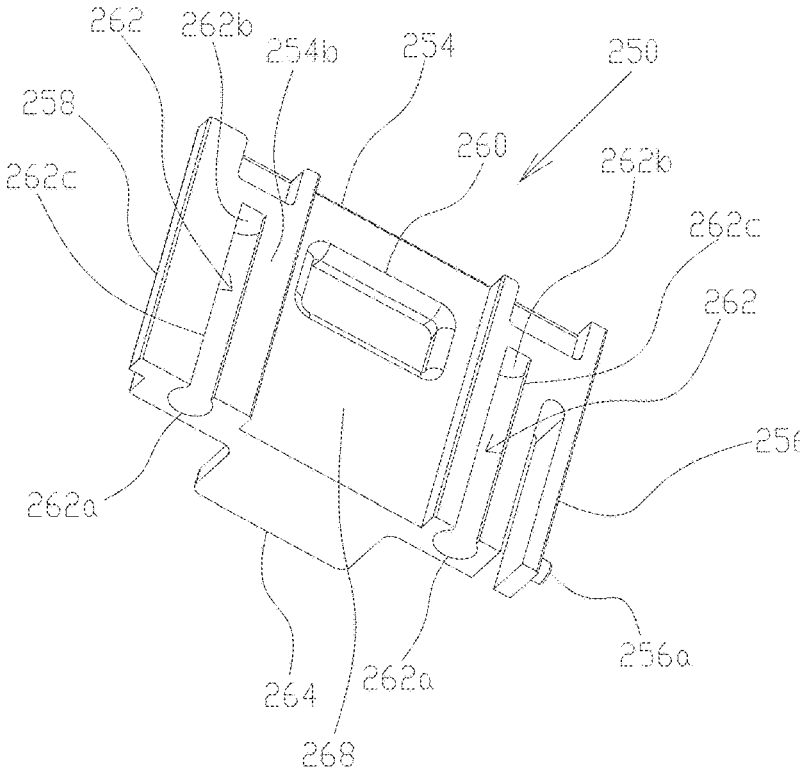
FIG. 9 is a perspective view of a switch member of the toner cartridge according to disclosed embodiments.

Referring to FIGS. 6, 7 and 9, the switch member 250 (e.g., the toner outlet switch) is detachably mounted on the toner cartridge 200. The switch member 250 can slide between an open position and a closed position (FIGS. 10-11) under the effect of a compression spring 251. The switch member 250 includes a body 254, and one side of the body 254 is a resilient arm 256. A protrusion 256*a* is provided on the outer surface of the end portion of the resilient arm 256, and a gap is provided between the resilient arm 256 and the body 254. The resilient arm 256 can be bent towards the body 254 and can revert back to its original position afterwards.

A rail 258 is provided on one side of the body 254 corresponding to the resilient arm 256, and the rail 258 is formed by inwardly recessing the outer surface 254*a* of the body 254 of the switch 250 toward the inner surface 254*b*. The body 254 is provided with an intermediate outlet 260, and one or more receiving slots 262 for the compression springs 251 are disposed between the intermediate outlet 260 and the rails 258/resilient arm 256.

The compression spring 251 can be inserted into the receiving slot 262 through open end 262*a* of the receiving slot 262. One end of the compression spring 251 abuts the closed end 262*b* of the receiving slot 262, and the other end of the compression spring 251 can extend out the open end 262*a* of the receiving slot 262 freely.

The receiving slot 262 may also have a side opening 262*c*, and the side opening 262*c* is located on the inner surface 254*b* of the body 254 of the switch member 250. The width of the side opening 262*c* is less than the outer diameter of the compression spring 251, such as to prevent the compression spring 251 from falling out on the side of the inner surface 254*b* of the body 254.

Accordingly, with the compression springs 251 being embedded in the switch member 250, such switch structure can make the overall structure more compact and space-saving. For example, in certain embodiments, a pair of receiving slots 262 may be used. The receiving slots 262 may be disposed symmetrically on both sides of the intermediate outlet 260, so as to ensure that the switch member 250 to receive more balanced force during the movement of the switch member 250.

At the end of the body 254 of the switch member 250 where the open ends 262*a* of the receiving slots 262 are located, the force receiving portion 264 extends downward, and the side surface of the force receiving portion 264 form a certain angle a with the outer surface of the body 254 of the switch member 250, $0° < \alpha < 180°$ (FIG. 6). In certain embodiments, the angle a may be approximately 90°, i.e., the direction in which the force receiving portion 264 extends is perpendicular to the outer surface 254*a* of the body 254 of the switch member 250.

Figure 13:
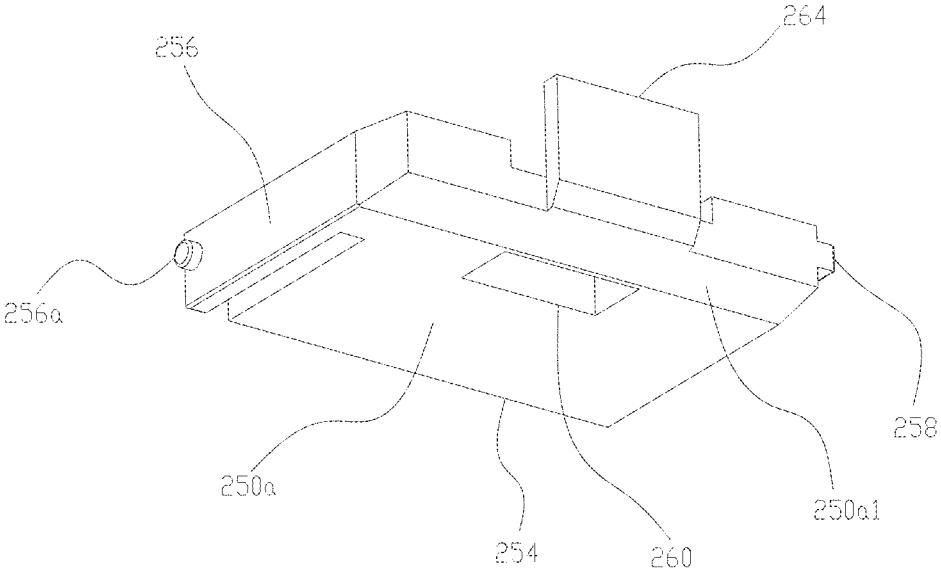
FIG. 13 is a perspective view of a force receiving portion of the switch member according to disclosed embodiments.

As shown in FIG. 13, the force receiving portion 264 of the switch member 250 may also be disposed at the distal end of the switch member 250, opposite to the end of the body 254 of the switch member 250 where the open ends 262*a* of the receiving slots 262 are located, and extends in the direction from the outer surface 254*a* of the body 254 of the switch member 250 to the inner surface 254*b*.

Without any external force, the body 254 is in a closed position, there is still a distance L (FIG. 10) between the intermediate outlet 260 and the closest side of the toner outlet 252. Thus, after the toner cartridge is inserted into the imaging device and contacts with the imaging device, the toner cartridge needs to slide over the distance before the toner outlet 252 is opened, delaying the time opening the toner outlet 252 and substantially reducing the toner leakage.

Figure 10:
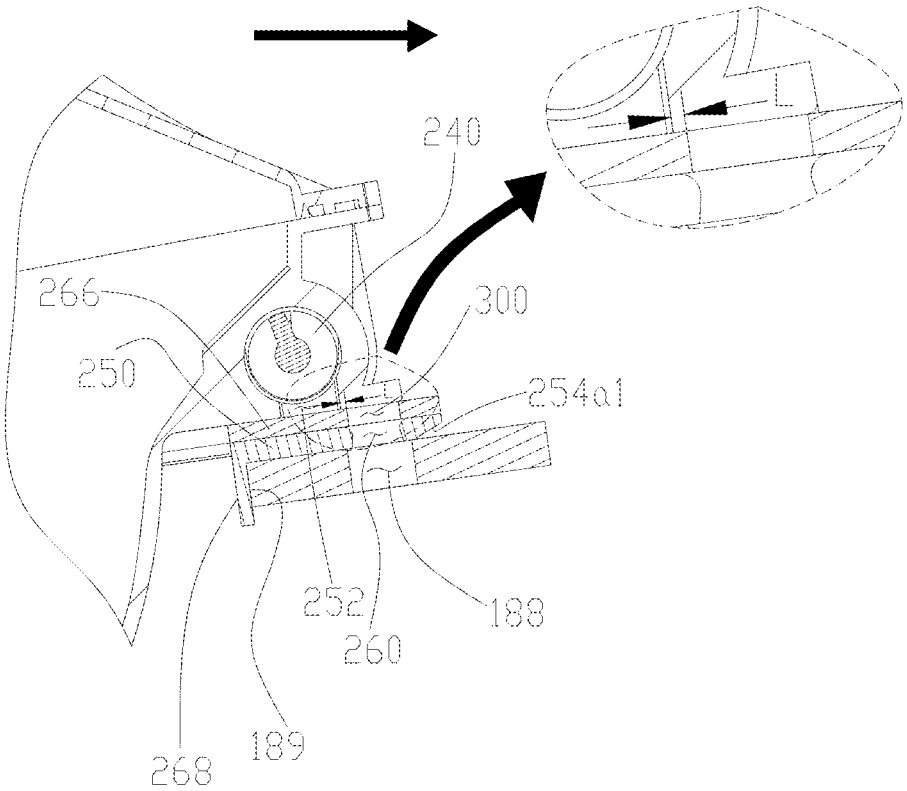
FIG. 10 is a partial sectional view of a toner cartridge installed in the printer according to disclosed embodiments.
Figure 11:
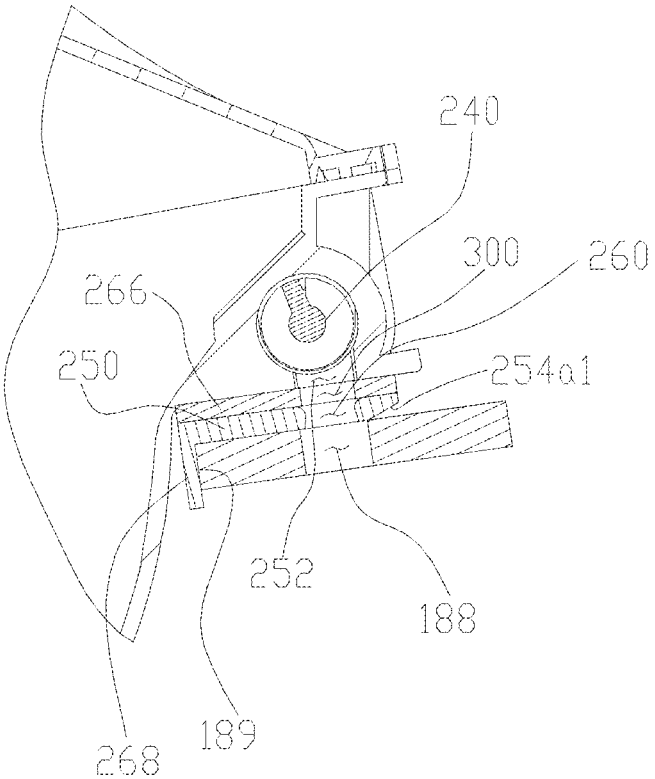
FIG. 11 is another partial sectional view of a toner cartridge installed in the printer according to disclosed embodiments.

Further, a groove 268 for receiving a sealing member 266 (FIGS. 10-11) can also be provided at a center location around the intermediate outlet 260. The groove 268 may be formed by recessing corresponding inner surface 254*b* of the body 254 of the switch member 250 towards the outer surface 254*a*. The sealing member 266 may have sealing member opening 300 corresponding to the intermediate outlet 260/toner outlet 252 of the switch member 250 (FIG. 10-11). The sealing member 266 can be adhered to the groove 268 of the inner surface 254*b* of the body 254, or to the mounting portion 270 of the switch member 250. Further, a guide surface 254*a*1 may be provided at the distal end of the outer surface 254*a* of the body 254. The guide surface 254*a*1 may form an obtuse angle with the outer surface 254*a* and an acute angle with the inner surface 254*b*.

Figure 8:
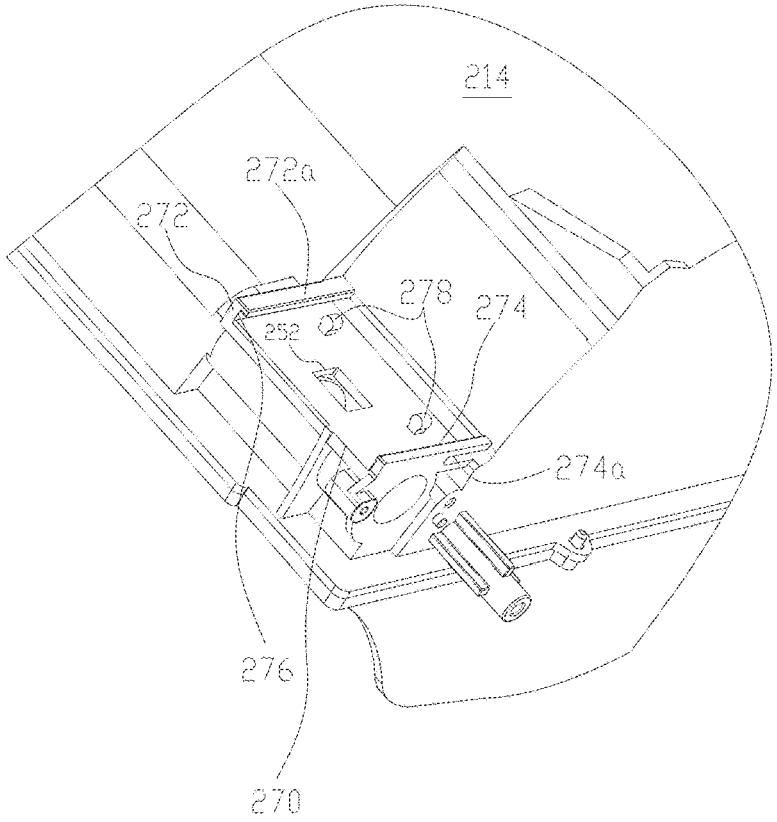
FIG. 8 is a perspective view of a toner cartridge according to disclosed embodiments.

Referring to FIGS. 7-8, a switch mounting portion 270 of may be disposed at the bottom of the closed portion 242*b* of the channel 242. The switch mounting portion 270 may be a horizontal plane extending in the direction from the front wall 214 of the toner cartridge 200 to the rear wall 216, and the switch mounting portion 270 matches with the inner surface 254*b* of the body 254 of the switch member.

In the longitudinal extension of the toner cartridge 200 (i.e., the "z" direction), a first sidewall 272 of the switch mounting portion 270 and a second sidewall 274 of the switch mounting portion 270 are disposed on both ends of the switch mounting portion 270 and perpendicular to the switch mounting portion 270. The first sidewall 272 of the switch mounting portion and the second sidewall 274 of the switch mounting portion extend in the direction from the front wall 214 of the toner cartridge 200 to the rear wall 216 (i.e., in the "x" direction).

The end of the first sidewall 272 of the switch mounting portion has an extended portion 272*a* extending in the direction towards the second sidewall 274 of the switch mounting portion. The extended portion 272*a* and the switch mounting portion form a guide slot 276 of the switch mounting portion 270. The rail 258 of the switch member 250 can slide in the guide slot 276. Further, the extended portion 272*a* can fasten or couple with the rail 258 of the switch member 250 to achieve the vertical (i.e., the "y" direction) positioning of the switch member 250 on the switch mounting portion 270.

On the side close to the front wall 214 of the toner cartridge 200, the second sidewall 274 of the switch mounting portion has a guide slot 274*a*. The protrusion 256*a* on the resilient arm 256 of the switch member 250 snaps into the guide slot 274*a* to achieve the horizontal or back-and-forth (i.e., the "x" direction) positioning of the switch member 250 on the switch mounting portion 270. The length of the guide slot 274*a* is the distance in which the switch member 250 can move on the switch mounting portion 270.

The toner outlet 252 includes an internal hollowed portion of switch mounting portion 270 facing the closed portion 242*b* of the channel 242. On the side close to the front wall 214 of the toner cartridge 200, a pair of blocking portions 278 are disposed on the switch mounting portion 270. The blocking portion 278 abuts one end of the compression spring 251 located at the side of the open end 262*a* of the receiving slot 262. The size of the cross-section of the blocking portion 278 is smaller than the size of the cross-section of the receiving slot 262 for the compression spring 251, so as to ensure that the blocking portion 278 can slide in the receiving slot 262 for the compression spring 251. The pair of blocking portions 278 are located at two sides of the toner outlet 252, and close to the front wall 214 of the toner cartridge 200.

Referring to FIGS. 6-9, an installation process of the switch member is illustrated. First, the switch member 250 is placed with the inner surface 254*b* facing upward, the compression spring 251 is inserted into the receiving slot 262 through the open end 262*a* of the receiving slot 262. One end of the compression spring 251 abuts the closed end 262*b* of the receiving slot 262, and the other end of the compression spring 251 extends out of the open end 262*a* of the receiving slot 262.

Further, the switch member 250 mounted with the compression spring 251 is turned over to have the inner surface 254*b* of the switch member 250 facing the switch mounting portion 270. Then, the resilient arm 256 of the switch member 250 is pressed to bend inwardly the resilient arm 256 towards the switch member 250, such that the rail 258 can slides into the guide slot 276, and the protrusion 256*a* of the resilient arm 256 contacts with the side surface of the second sidewall 274 of the switch mounting portion 270.

Further, the switch member 250 is pushed and the rail 258 slides in the guide slot 276. The protrusion 256*a* of the resilient arm 256 slides on the side surface of the second sidewall 274 of the switch mounting portion, until the protrusion 256*a* of the resilient arm 256 snaps into the guide slot 274*a*. At this moment, the pressure on the resilient arm 256 is released, and the resilient arm 256 returns to the force-free state. The end of the compression spring extending out of the open end 262*a* of the receiving slot 262 abuts with the blocking portion 278, and the compression spring 251 is compressed in the receiving slot 262.

In the closed position of the switch member 250, under the effect of the compression spring 251, the distal end of the switch member 250 projects out of the switch mounting portion 270. At this time, the intermediate outlet 260 of the switch member 250 is in a staggered position with respect to the toner outlet 252 of the toner cartridge, and the toner is blocked. In the installation direction of the toner cartridge (i.e., the "x" direction), the intermediate outlet 260 of the switch member 250 is located at downstream of the toner outlet 252 of the toner cartridge.

In the open position of the switch member 250, the switch member 250 is retracted by the applied force, the intermediate outlet 260 of the switch member 250 is in a docked position with respect to the toner outlet 252 of the toner cartridge, i.e., the intermediate outlet 260 is aligned with the toner outlet 252. The toner outlet 252 is not blocked and the toner can flow out from the toner outlet 252 and the intermediate outlet 260.

Referring to FIGS. 10-11, a process of the switch member 250 opening and closing the toner outlet 252 is illustrated. Because the sealing member 266 is attached to the switch member 250, the sealing member 266 moves together with the switch member 250. Thus, the movement of the switch member 250 may be treated as the movement of the sealing member 266, and descriptions on the sealing member 266 is omitted for simplicity purposes.

Before the toner cartridge 200 is installed in the printer, the switch member 250 is in the closed position, i.e., the intermediate outlet 260 of the switch member 250 is staggered with the toner outlet 252 of the toner cartridge.

Figure 1:
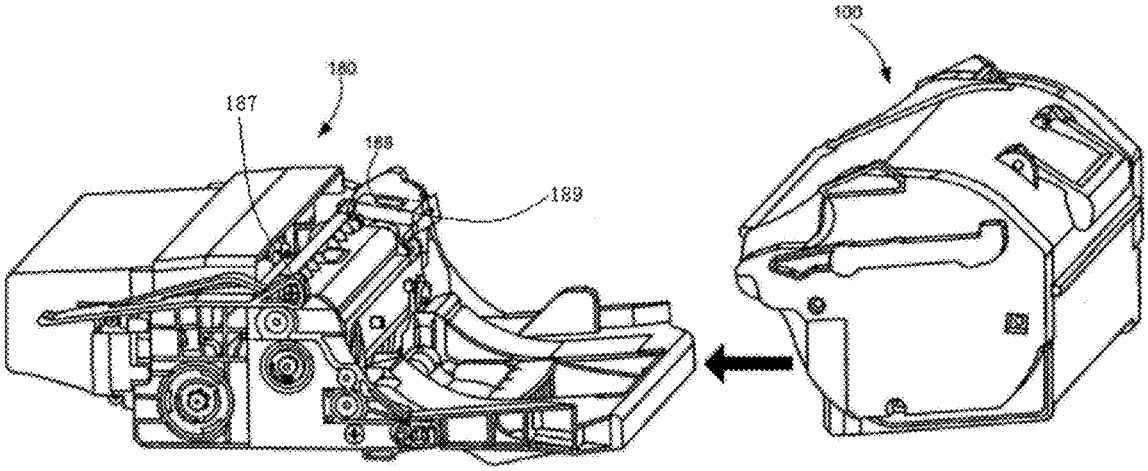
FIG. 1 (Prior Art)
FIG. 1 illustrates an existing imaging device and toner cartridge.
Figure 2A:
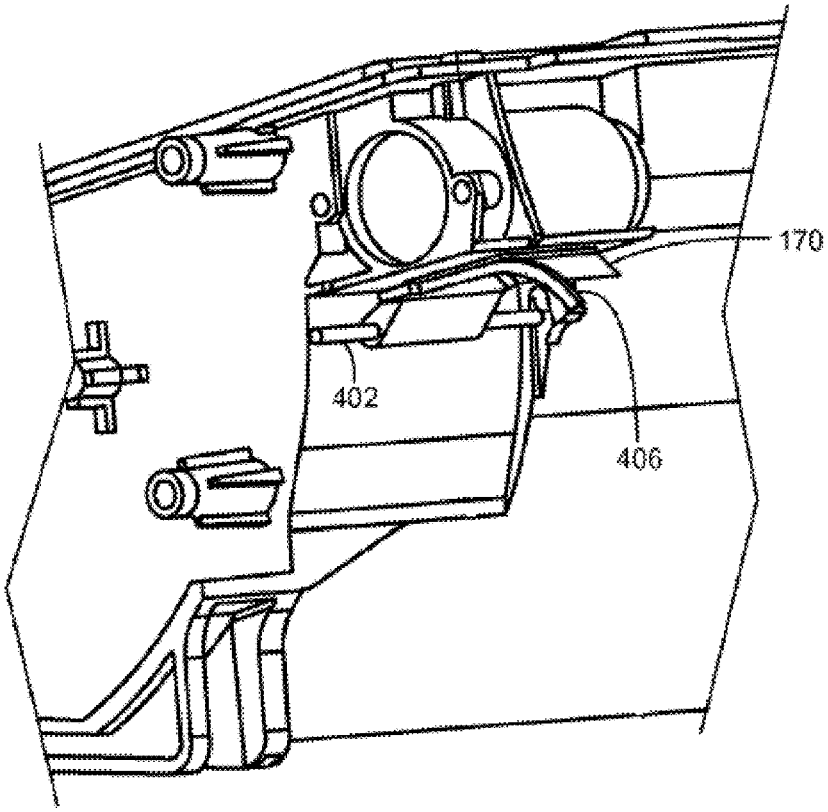
FIG. 2A (Prior Art)
FIGS. 2A-2B show is toner outlet switch in an existing toner cartridge in the open state and close state.
Figure 2B:
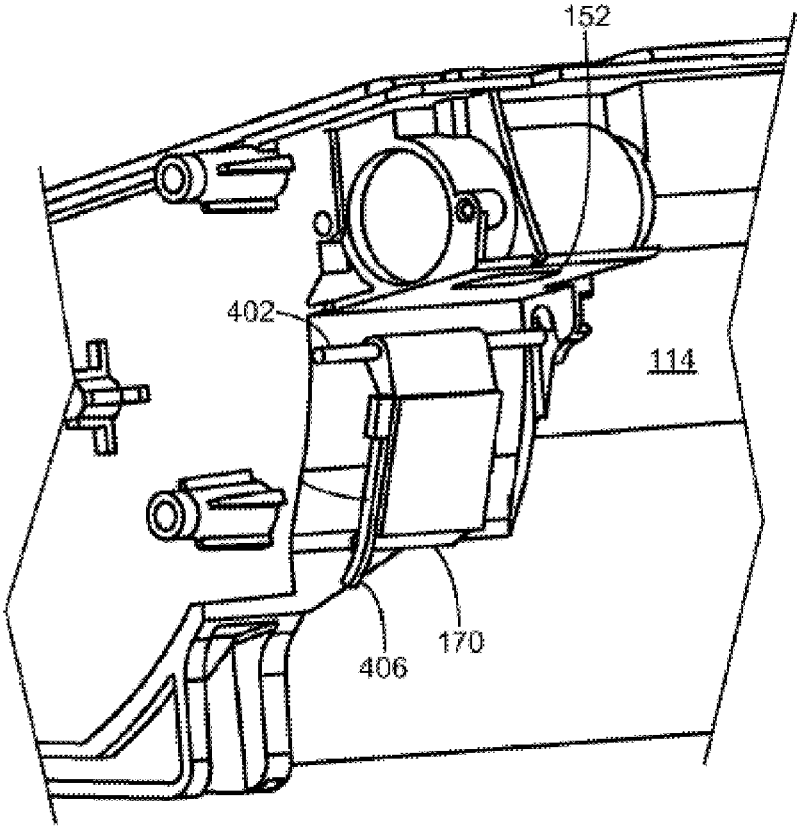
FIG. 2B (Prior Art)

When the toner cartridge 200 is inserted into the imaging device along the arrow direction (the installation direction) as shown in FIG. 10, the intermediate outlet 260 of the switch member 250 is located at downstream of the toner outlet 252 of the toner cartridge. Along the insertion process of the toner cartridge 200, the guide surface 254*a*1 of the switch member 250 guides the outer surface of the switch member 250 to contact with the upper surface of the toner inlet 188 (FIG. 1) of the imaging device 180. Because the intermediate outlet 260 of the switch member 250 is located at downstream in the installation direction of the toner cartridge 200, the intermediate outlet 260 of the switch member 250 is first aligned with the toner inlet 188 (FIG. 1) of the imaging device 180.

At the same time, the force receiving portion 264 of the switch member 250 abuts the edge 189 (FIG. 1) of the toner inlet 188 of the imaging device 180 (if the force receiving portion 264 is disposed at the distal end of the switch member 250, the force receiving portion 264 abuts the corresponding portion of the imaging device 180 facing the edge 189 of the toner inlet 188). Thus, the switch member 250 does not move relative to the toner inlet 188 of the imaging device 180. At this time, the toner outlet 252 of the toner cartridge 200 remains in the closed state, as shown in FIG. 9.

When the toner cartridge 200 is further inserted into the printer, the toner outlet 252 of the toner cartridge 200 moves closer to the intermediate outlet 260 of the switch member 250 and the toner inlet 188 of the imaging device 180. The rail 259 of the switch member 250 is in the guide slot 276, the protrusion 256*a* on the resilient arm 256 of the switch member 250 is in the guide slot 274*a*, blocking portion 278 slides in the receiving slot 262, and the compression spring 251 is compressed.

When the toner cartridge 200 reaches the final position, i.e., when the cartridge stopper groove 221 on the second end cover 220 of the toner cartridge 200 abuts with the stopper protrusion 187 of the imaging device, the toner cartridge 200 becomes still relative to the imaging device 180. The toner outlet 252 of the toner cartridge is aligned with the intermediate outlet 260 of the switch member 250 and the toner inlet 188 of the imaging device 180. The switch member 250 opens the toner outlet 252 of the toner cartridge, and the toner can flow into the imaging device 180 from the toner cartridge 200.

Because the intermediate outlet 260 of the switch member 250 is located at downstream of the toner outlet 252, the disclosed structure can achieve a staged opening of the toner outlet of the toner cartridge, e.g., the intermediate outlet 260 of the switch member 250 is first aligned with the toner inlet 188 of the imaging device 180, and then the toner outlet 252 of the toner cartridge, the intermediate outlet 260, and the toner inlet 188 of the imaging device 180 are all aligned. Thus, the problem of toner leakage in the process of opening the toner outlet of the toner cartridge can be effectively improved.

Because the switch member includes a body with the intermediate outlet disposed in a center location, the body slidably connects with the housing at the location of the toner outlet, and compression springs are placed between the body and the housing. That is, even if there is toner leakage, the toner outlet is opened by the horizontal movement of the switch member, the leaked toner during the opening process can only fall on the location of the imaging device corresponding to the toner outlet, and does not flow along the switch member from the toner outlet and, thus, does not appear on any other location not corresponding to the toner outlet. Thus, other locations are not contaminated by the leaked toner, solving the problem of current toner cartridges with contamination of locations other than that corresponding to the toner outlet during opening the toner switch by rotation.

Referring to FIG. 6, a first support portion 217*a*, a second support portion 217*b*, and a third support portion 217*c* are disposed on the bottom surface 217 of the front wall 214 of the body of the toner cartridge 200 along the direction extended from the front wall 214 to the rear wall 216 (the "x" direction). The first support portion 217*a* and the second support portion 217*b* are located on both sides of the bottom surface 217 of the front wall 214, and close to the body 208, including the first sidewall 210 and the second sidewall 212. The third support portion 217*c* is located at the middle position of the bottom surface 217 of the front wall 214. In the direction to install the toner cartridge 200 into the printer (the "x" direction), the third support portion 217*c* is at the downstream of the first support portion 217*a* and the second support portion 217*b*, forming a triangular structure and improving the stability of the toner cartridge 200 mounted in the imaging device.

Figure 14:
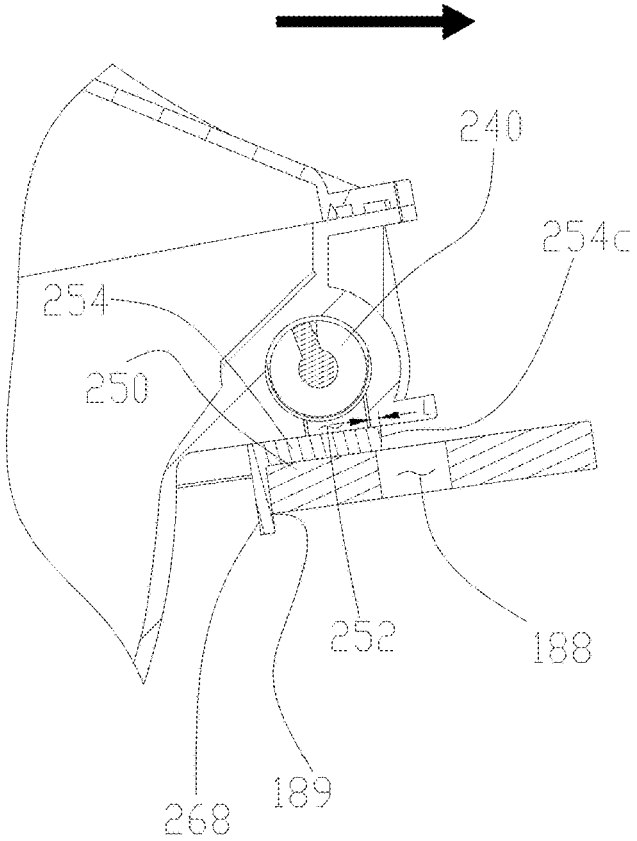
FIGS. 14-15 show a switch body of the switch member without an intermediate toner outlet in a closed position and an open position according to disclosed embodiments.
Figure 15:
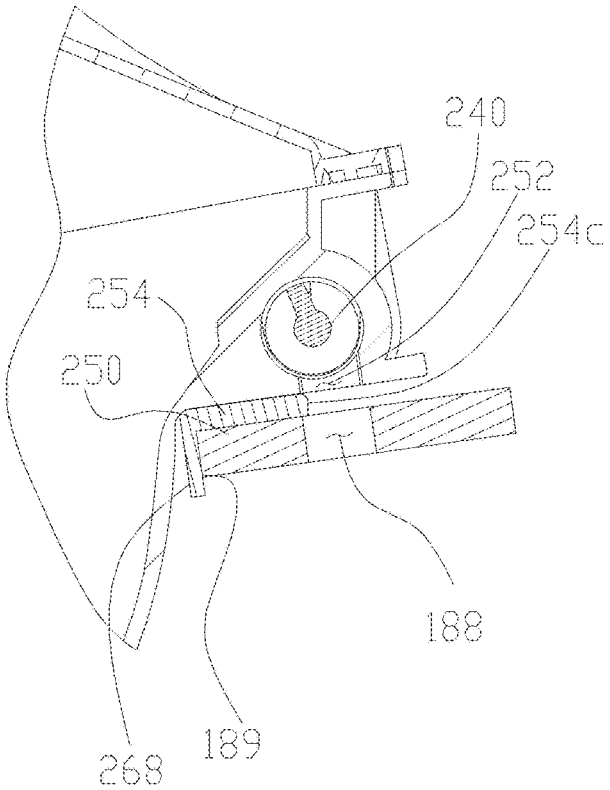

Alternatively or optionally, referring to FIGS. 14-15, the body 254 may not have the intermediate outlet 260, and the body 254 may be directly used to slide on the toner outlet 252 to achieve switch of the toner outlet. Without any external force, the closing edge 254*c* of the body 254 moves over the toner outlet 252 so as to close the toner outlet 252.

When an external force is applied on the toner cartridge, e.g., when being inserted into the printer, the body 254 slides and the closing edge 254*c* of the body 254 moves away from the toner outlet 252, opening the toner outlet 252. Further, there is a distance L between the closing edge 254*c* in the closed position where the body 254 and the closing edge 254*c* in the opening position. When being inserted into the imaging device, the toner cartridge needs to slide the distance L after contacting the imaging device before the toner outlet 252 is starting to be opened. The opening time of the toner outlet 252 is delayed, significantly reducing the toner leakage.

Figure 16:
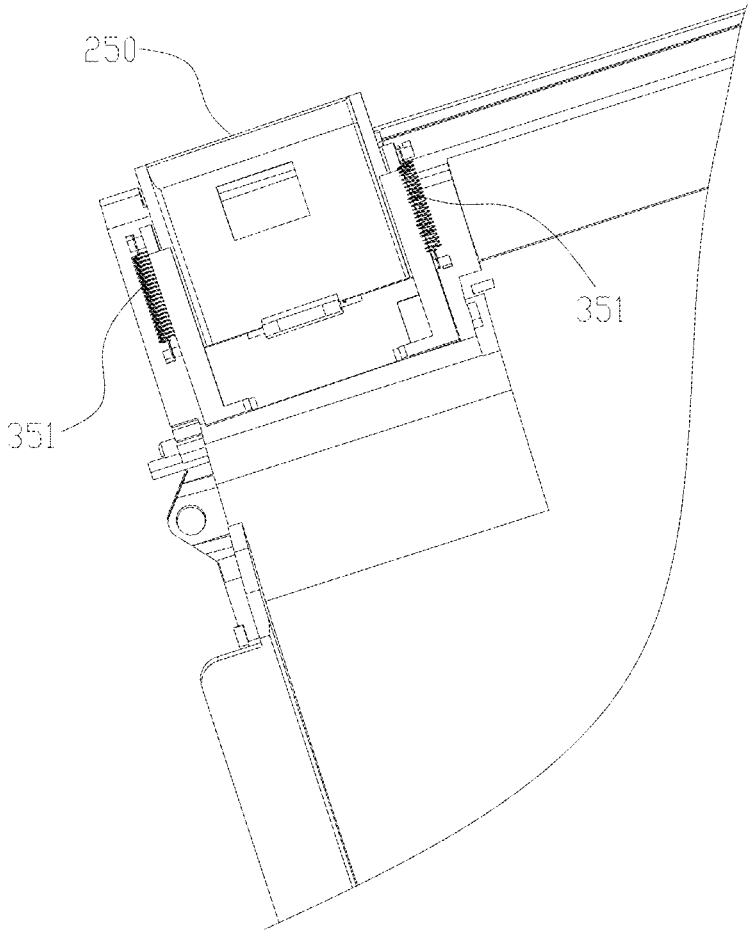
FIG. 16 is a perspective view of a tension spring used between a switch member and the toner cartridge according to disclosed embodiments.

Further, in certain embodiments, as shown in FIG. 16, the compression spring can be replaced by a tension spring. For example, a pair of tension spring 351 may be disposed at both sides of the switch member 250. One end of the tension spring 351 is connected to the switch member 250, and the other end of the tension spring 351 is connected to the housing of the toner cartridge.

Second Embodiment

Figure 17:
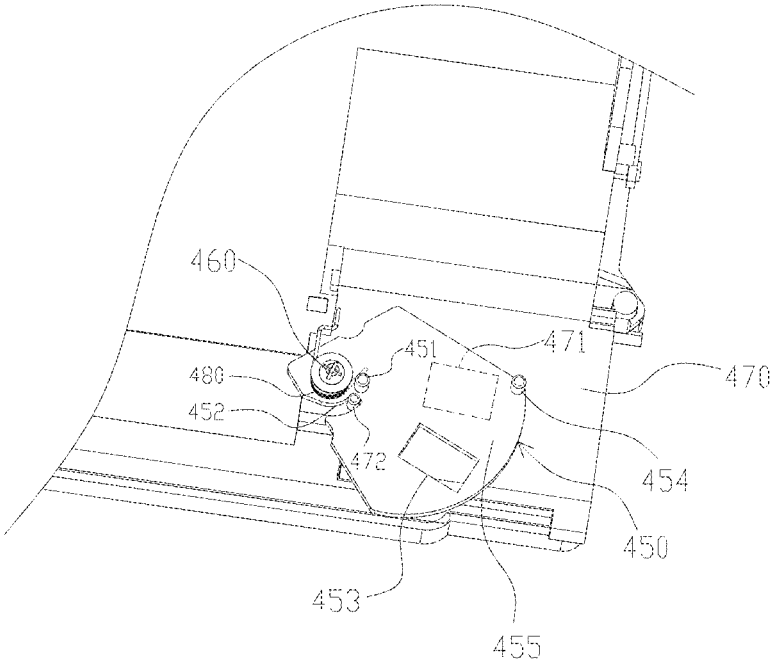
FIG. 17 is a perspective view of a switch member mounted according to disclosed embodiments.

FIG. 17 illustrates structures of a switch member and corresponding switch mounting portion of the toner cartridge. Other components may be the same as those described in the First Embodiment above.

As shown in FIG. 17, the toner-outlet switch or switch member 450 includes a switch body 455. The switch body 455 is connected to the switch mounting portion 470 through a connecting member 460, and the switch body 455 can rotate freely around the connecting member 460 on the surface plane of the switch mounting portion 470. A torsion spring 480 is mounted on the connecting member 460, with one end of the spring abutting the blocking portion 451 of the switch body 455 and the other end of the spring 480 abutting the housing of the toner cartridge.

A guide slot 452 is provided on the switch body 455, and a guide rod 472 is provided on the switch mounting portion 470, matching the guide slot 452 on the switch body 455. The guide slot 452 and the guide rod 472 are in the direction in which the torsion spring 480 applies elastic force on the switch body 455. The switch body 455 also includes a force receiving portion 454 and an intermediate outlet 453.

When the switch member 450 is in the closed position, closing the toner outlet 471, the torsion spring 480 applies a force on the switch members 450 through the blocking portion 451 to cause the intermediate outlet 453 away from the toner outlet 471. Thus, the intermediate outlet 453 is staggered with the toner outlet 471, and the toner outlet 471 is blocked or closed by the switch member 450. That is, the toner is enclosed inside the toner cartridge. The guide rod 472 abuts the closed end of the guide slot 452, limiting the position of the switch member 450.

When the toner cartridge is inserted into the laser printer, the force receiving portion 454 on the switch member 450 abuts the edge 189 of the imaging device. Initially, the switch member 450 remains still relative to the toner inlet 188. With the gradual insertion of the toner cartridge, the toner outlet 471 slides towards the intermediate outlet 453 and the toner inlet 188, and finally all three (the toner outlet 471, the intermediate outlet 453, and the toner inlet 188) are aligned. The toner can flow into the toner inlet 188 through the toner outlet 471 and the intermediate outlet 453.

Alternatively or optionally, the switch member may not be provided with the intermediate outlet, so as to reduce the area of the switch body. When the switch member closes the toner outlet, the two sides of the switch member are at two sides of the toner outlet, respectively. When the switch member opens the toner outlet, the two sides of the switch member are at a same side of the toner outlet. The torsion spring can also be replaced with a tension spring, with one end of the tension spring connected with the switch member and the other end of the tension spring connected to the housing of the toner cartridge.

Further, it can be assumed that, when the switch member completely blocks the toner outlet, the amount of the blockage is '1' and, when the switch does not block the toner outlet, the amount of the blockage is '0'; the amount of passage when the toner outlet and the toner inlet are completely aligned is '1', and the amount of passage when the toner outlet is not aligned with the toner inlet is '0'. During the installation process of the toner cartridge into the imaging device, the changes on the blockage amount of the switch member against the toner outlet, and on the passage amount between the toner outlet and the toner inlet are as follows.

The first stage, before the switch member contacts with the imaging device, the switch member blocks the toner outlet completely. At this stage, the blockage amount of the switch member against the toner outlet is '1' and the passage amount between the toner outlet and the toner inlet is '0.'

The second stage, after the switch member contacts with the imaging device, but before being fully installed in the imaging device, the blockage amount of the switch member against the toner outlet changes from '1' to '0'; and the passage amount between the toner outlet and the toner inlet changes from '0' to '1'.

The third stage, after the cartridge is fully installed, the blockage amount of the switch member against the toner outlet is '0' and the passage amount between the toner outlet and the toner inlet is '1.'

When the toner cartridge is removed from the imaging device, the changes of the blockage amount of the switch member against the toner outlet and the passage amount between the toner outlet and the toner inlet are reversed from the above descriptions, and details are omitted herein.

Thus, when the toner outlet moves closer to the toner inlet, first the switch member remains still relative to the toner outlet and the toner inlet, then the toner outlet slides or rotates with respect to the switch member to connect with the toner inlet. The toner leakage problem during the opening of the toner outlet of the toner cartridge by the switch member can be reduced significantly.

Third Embodiment

Figure 18:
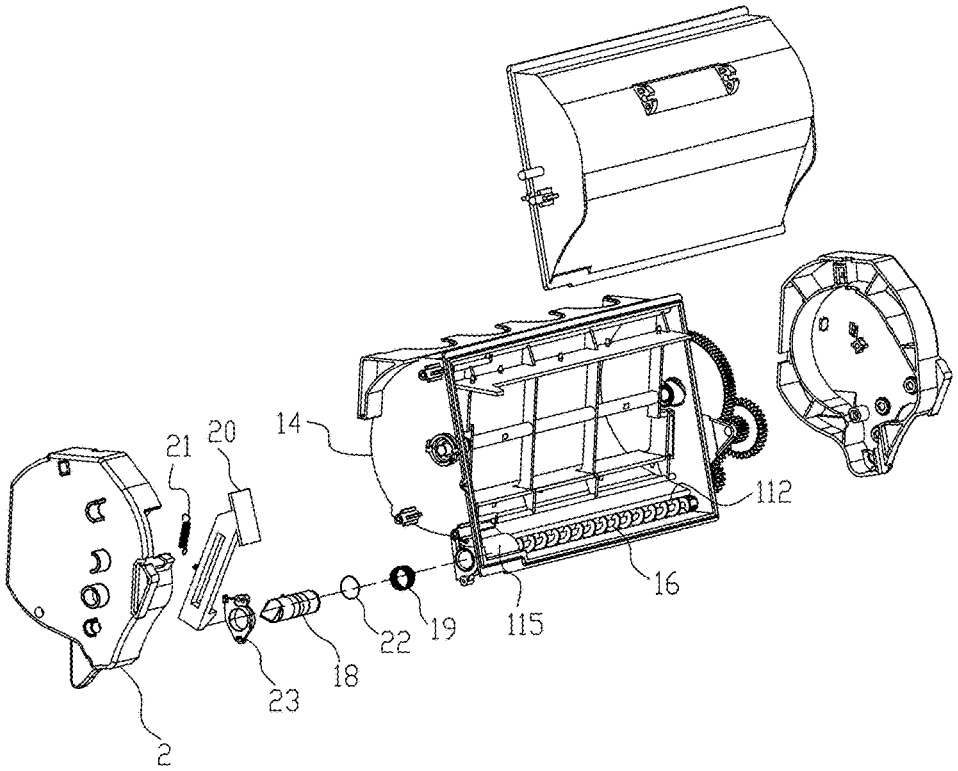
FIG. 18 is an exploded view of a toner cartridge according to disclosed embodiments.
Figure 19:
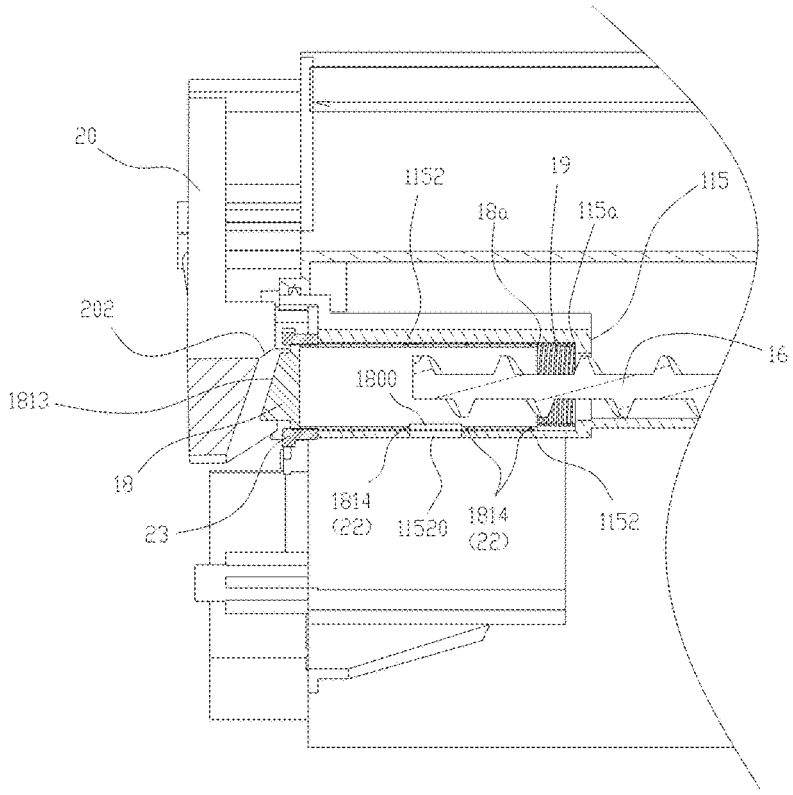
FIG. 19 is a cross-sectional schematic view of a toner outlet switch in an open state according to disclosed embodiments.
Figure 20:
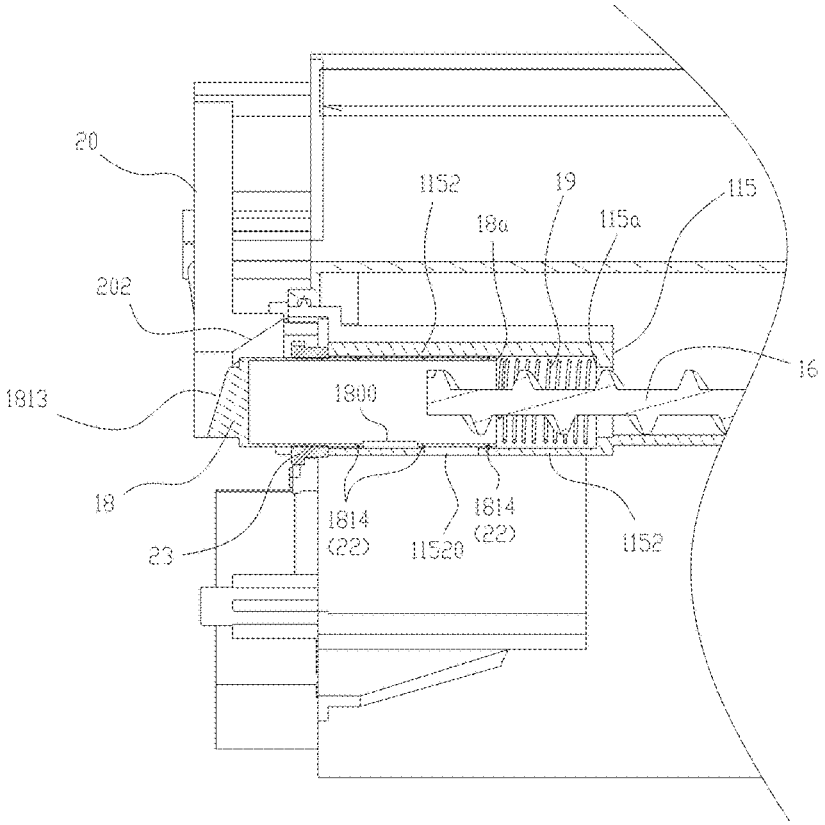
FIG. 20 is a cross-sectional schematic view of another toner outlet switch in an open state according to disclosed embodiments.

The difference between the present embodiment and above described embodiments include certain components for opening and closing the toner outlets. Referring to FIGS. 18, 19 and 20, the toner transport portion 115 is provided with a hollow outer cylinder 1152, and one end of the toner feeding auger 16 extends into the outer cylinder 1152. The outer cylinder 1152 houses a toner-outlet switch 18, and the toner-outlet switch 18 is a hollow cylinder with one closed end. The toner-outlet switch 18 can slide in the outer cylinder 1152.

The outer cylinder 1152 has an external toner outlet 11520 on its peripheral wall at the direction toward the bottom of the toner cartridge, and the toner-outlet switch 18 has an intermediate toner outlet 1800. When the external toner outlet 11520 is aligned with the intermediate toner outlet 1800, the toner-outlet switch 18 is in an open position (FIG. 19), and the toner can flow into the imaging device from the toner cartridge through the external toner outlet 11520 and the intermediate toner outlet 1800. When the external toner outlet 11520 is staggered with the intermediate toner outlet 1800, the toner-outlet switch 18 is in a closed position (FIG. 20), and the toner cannot flow into the imaging device from the toner cartridge.

Figure 23:
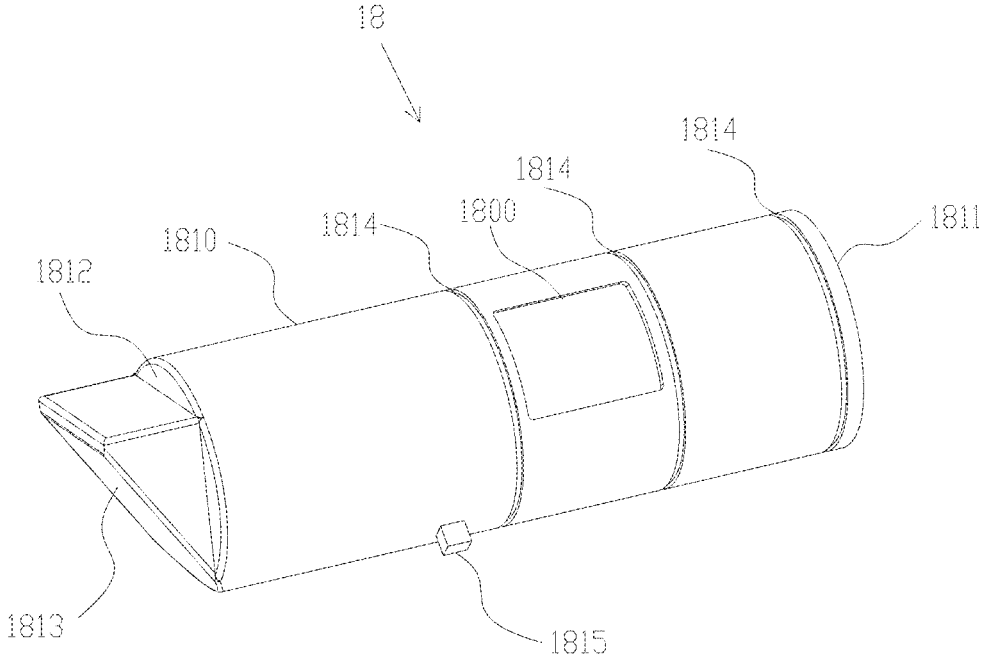
FIG. 23 is a perspective view of a toner outlet switch according to disclosed embodiments.

Referring to FIG. 23, the toner-outlet switch 18 includes: a body 1810 and the intermediate toner outlet 1800 disposed on the body 1810. The body 1810 is a hollow cylinder having an open end 1811 and a closed end 1812. When the toner outlet switch 18 is mounted into the outer cylinder 1152, the open end 1811 faces toward of the toner transfer slot 112, and one end of the toner feeding auger 16 extends inside the body 1810 through the open end 1811.

A power receiving unit 1813 is provided on the closed end 1812. For example, the power receiving unit 1813 may be a slope or a slant surface. Within the outer cylinder 1152, an internal elastic member 19 is provided between the toner-outlet switch 18 and the toner transport portion 115, one end of the internal elastic member 19 abuts the annular end surface 181*a* of the open end 1811 of the toner outlet switch 18, and the other end abuts the end wall 115*a* on one side of the inner wall of the toner transport portion 115.

The toner-outlet switch 18 slides or translates between the open position (opening the toner outlet) and the closed position (closing the toner outlet) by a driving device. As shown in FIGS. 18 and 20, the driving device includes a pressing member 20 disposed between a first side cover 2 and a first sidewall 14, for pressing the toner-outlet switch 18 such that the toner-outlet switch 18 can slide or translate within the outer cylinder 1152 of the toner transport portion 115.

The pressing member 20 includes a pressing body 20*a*, one end of the pressing body 20*a* is provided with a pushing portion 201, and the other end is provided with a power transfer portion 202. The pushing portion 201 contacts the pushing device in the printer to receive a pushing force or a thrust. In certain embodiments, the power transfer portion 202 is an inclined surface and matches with the force receiving portion 1813 of the toner-outlet switch 18 to transfer driving power.

The pressing body 20*a* is slidably connected to the first sidewall 14, and the slidable connection may include one or more fixed rod or fixed block engaged with a slide groove, or engaged guide rail/guide slot, etc. For example, to connect the pressing member 20 and the housing of the toner cartridge, the pressing body 20*a* has an elongated guide slot 203 in the middle of the pressing body 20*a*, which matches with two guide rail protrusions 141 on the first sidewall 14. That is, the two guide rail protrusions 141 can be inserted into the elongated guide slot 203, and the elongated guide slot 203 is guided by the guide rail protrusions 141 to slide along the sidewall 14 of the housing of the toner cartridge.

Further, the driving device may also include an external elastic member 21, one end of the elastic member 21 is connected with the pressing member 20, and the other end is connected with the sidewall 14. Using the elastic restoring force of the external elastic member 21, the pressing member 20 can be sliding back to the initial position after pressing the toner-outlet switch 18.

Figure 21:
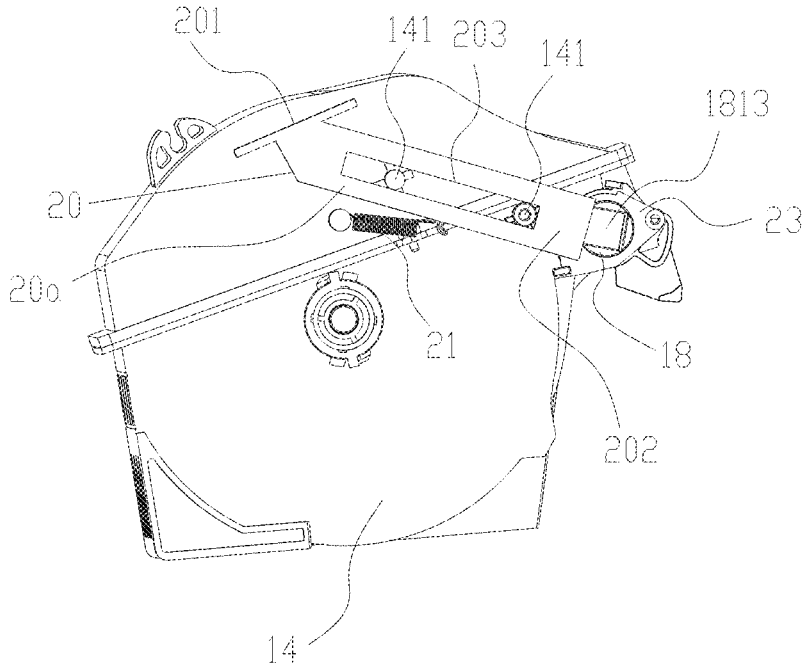
FIG. 21 is a left side view of a toner cartridge with the first side cover removed according to disclosed embodiments.

Referring to FIGS. 19, 20 and 21, before the toner cartridge is installed in the printer, under the elastic force of the internal elastic member 19, the intermediate toner outlet 1800 of the toner-outlet switch 18 is staggered with the external toner outlet 11520, and the toner passage is closed, as shown in FIG. 20.

After the toner cartridge is inserted into the printer, the external toner outlet 11520 is aligned with the toner inlet 188 of the imaging device, entering the preparation stage for toner transfer. When the cover of the printer is closed, the pushing device on the printer cover applies a pushing force on the pushing portion 201 of the pressing member 20, pushing the pressing member 20 to overcome the spring tension of the external elastic member 21 and to slide towards the toner-outlet switch 18 guided by the guide rail protrusions 141. Thus, the toner-outlet switch 18 overcomes the spring tension of the internal elastic member 19 and slides inside the cylinder chamber 1000, until the intermediate toner outlet 1800 and the external toner outlet 11520 are aligned, as shown in FIG. 20. At this time, the toner is transferred by the toner feeding auger 16 to the outer cylinder 1152 of the toner transport portion 115, and further enters into the toner inlet 188 of the imaging device via the intermediate toner outlet 1800 and the external toner outlet 11520.

The sliding direction of the toner-outlet switch 18 is perpendicular to and the sliding direction of the pressing member 20, and the sliding movement of the pressing member 20 is converted to the translational movement of the toner-outlet switch 18, simplifying the overall structure and increasing the reliability.

To ensure that the toner-outlet switch 18 can slide smoothly, certain gap may be maintained between the toner-outlet switch 18 and its matching parts (e.g., the outer cylinder 1152). During the toner flow process, some toner may enter into the gap. To prevent the toner remained in the gap from leaking out when the toner outlet of the toner cartridge is in a closed state, a sealing member may be provided surrounding the toner-outlet switch 18.

For example, as shown in FIG. 23, a plurality of annular sealing grooves 1814 are provided on the outer wall of the switch body 1810 of the toner-outlet switch 18, and annular sealing members 22 are mounted in the annular sealing grooves 1814. In certain embodiments, at each of the two sides of the intermediate toner outlet 1800 of the toner-outlet switch 18, at least one sealing member is mounted. Thus, the toner can be prevented from entering the cylinder chamber 1000 from the intermediate toner outlet 1800, avoiding the toner leakage from the external toner outlet 11520. In one embodiment, the annular sealing member may be an elastic rubber ring.

Figure 22:
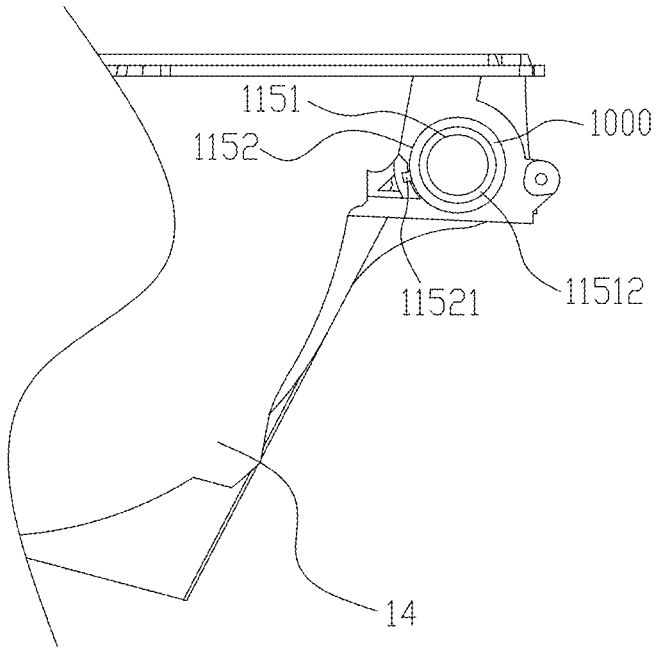
FIG. 22 is a left side view of the toner cartridge housing according to disclosed embodiments.
Figure 24:
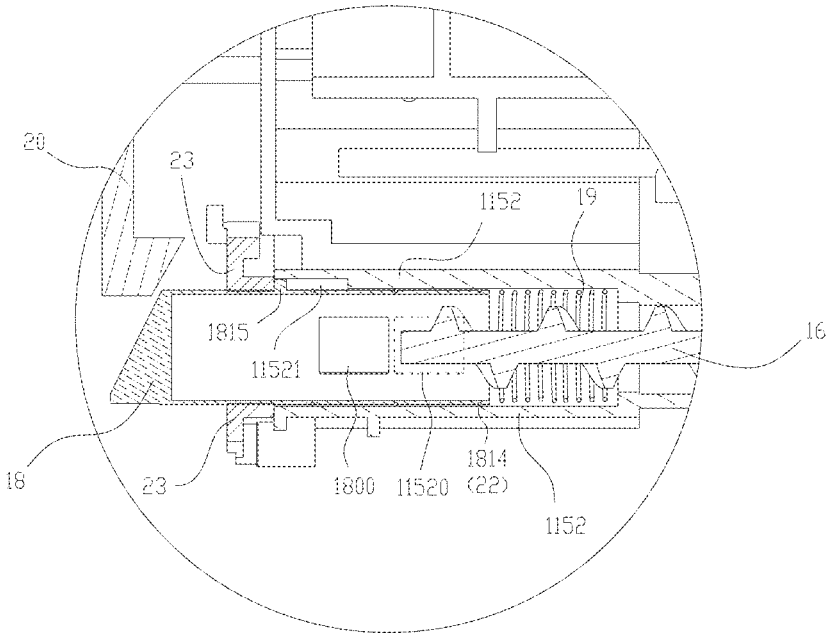
FIG. 24 is a perspective view of a toner outlet switch with axial positioning according to disclosed embodiments.

Further, the axial positioning of the toner-outlet switch 18 may be realized by the power transfer portion 202 of the pressing member 20 abutting the force receiving portion 1813 of the toner-outlet switch 18. The pressing member 20 is limited on the first sidewall 14 by the first side cover 2. Further, the positioning protrusion 1815 may be provided on the toner-outlet switch 18 to engage the groove 11521 on the inner wall of the outer cylinder 1152. That is, the positioning protrusion 1815 on the toner-outlet switch 18 can slide within the groove 11521 on the inner wall of the outer cylinder 1152, and the axial positioning member 23 can block the groove 11521 at the first sidewall 14 to realize the axial positioning. The axial positioning member 23 can loop or jacket the toner-outlet switch 18 and is fastened on the first sidewall 14, as shown in FIGS. 22 and 24.

Fourth Embodiment

This embodiment is a modification on the basis of the Third Embodiment. More specifically, the toner transport portion 115 is provided with an inner cylinder 1151 and an outer cylinder 1152. One end of the toner feeding auger 16 extends into the inner cylinder 1151. The cylindrical chamber 1000 is provided between the inner cylinder 1151 and the outer cylinder 1152.

The toner-outlet switch 18 is contained in the cylindrical chamber 1000, and is a hollow cylinder with one closed end. The toner-outlet switch 18 can slide between the inner cylinder 1151 and the outer cylinder 1152, i.e., slide within the cylinder chamber 1000. An internal toner outlet 11510 is provided on the peripheral wall of the inner cylinder 1151 along the direction to the bottom of the toner cartridge. An external toner outlet 11520 is provided on the peripheral wall of the outer cylinder 1152 along the direction to the bottom of the toner cartridge. The internal toner outlet 11510 and the external toner outlet 11520 are aligned.

When the internal toner outlet 11510, the external toner outlet 11520, and the intermediate toner outlet 1800 are all aligned, the toner-outlet switch 18 is in the open position. That is, the toner can flow into the imaging device from the toner cartridge through these toner outlets. When the intermediate toner outlet 1800 is staggered with the internal toner outlet 11510 and the external toner outlet 11520, the toner-outlet switch 18 is in the closed position, and the toner cannot flow into the imaging device from the toner cartridge. Further, the internal elastic member 19 is provided with the cylinder chamber 1000, one end of the internal elastic member 19 abuts the toner-outlet switch 18, and the other end abuts the inner wall of the cylinder chamber 1000.

Figure 19A:
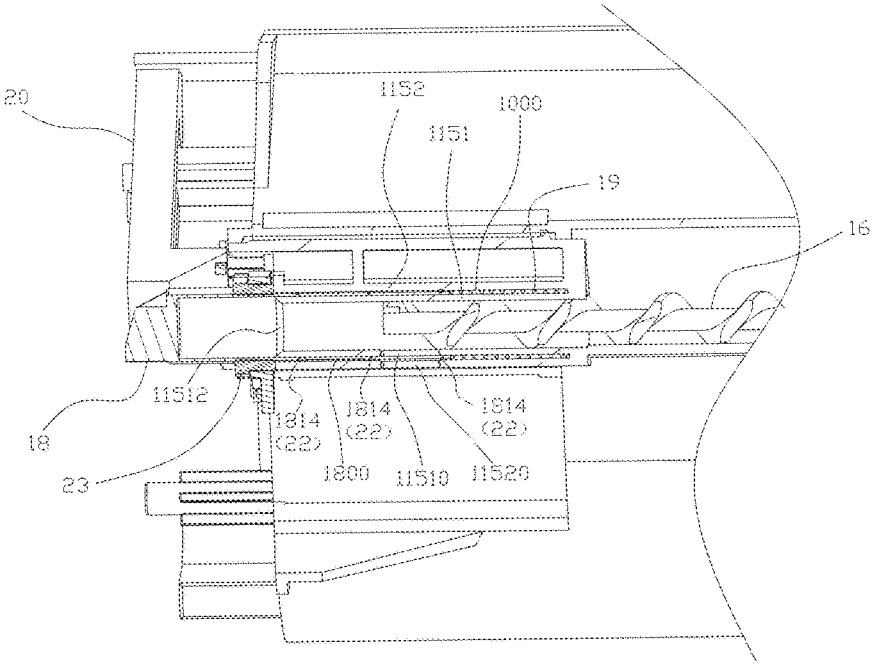
FIG. 19*a* is a cross-sectional schematic view of a toner outlet switch in a closed state according to disclosed embodiments.
Figure 20A:
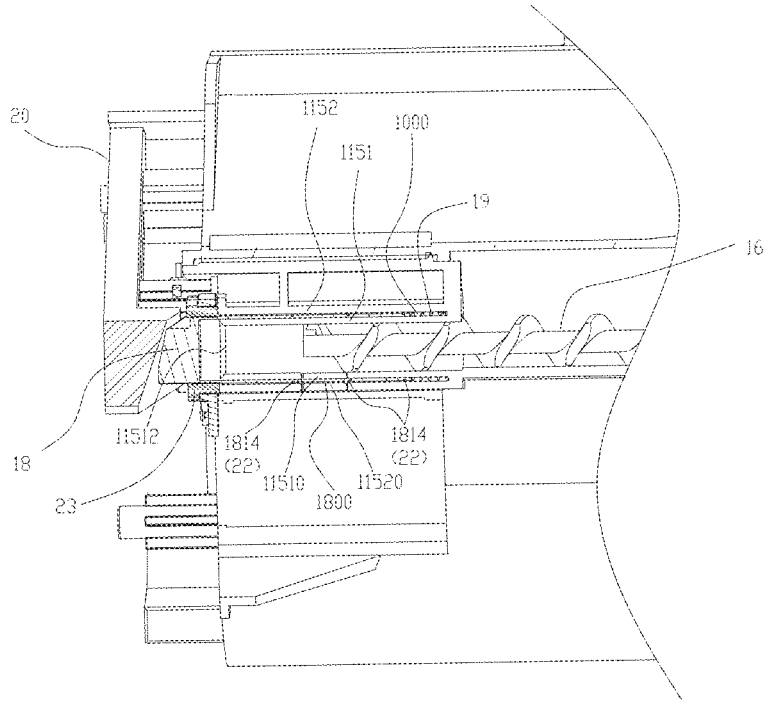
FIG. 20*a* is a cross-sectional schematic view of another toner outlet switch in a closed state according to disclosed embodiments.

Referring to FIGS. 19*a*, 20*a*, and 21, before the toner cartridge is installed in the printer, under the elastic force of the internal elastic member 19, the intermediate toner outlet 1800 of the toner-outlet switch 18 is staggered with the internal toner outlet 11510 and the external toner outlet 11520, and the toner passage is closed, as shown in FIG. 19*a*.

After the toner cartridge is inserted into the printer, the external toner outlet 11520 is aligned with the toner inlet 188 of the imaging device, entering the preparation stage for toner transfer. When the cover of the printer is closed, the pushing device on the printer cover applies a pushing force on the pushing portion 201 of the pressing member 20, pushing the pressing member 20 to overcome the spring tension of the external elastic member 21 and to slide towards the toner-outlet switch 18 guided by the guide rail protrusions 141. Thus, the toner-outlet switch 18 overcomes the spring tension of the internal elastic member 19 and slides within the cylinder chamber 1000, until the intermediate toner outlet 1800, the internal toner outlet 11510, and the external toner outlet 11520 are all aligned, as shown in FIG. 20*a*. At this time, the toner is transferred by the toner feeding auger 16 to inner cylinder 1151 of the toner transport portion 115, and further enters into the toner inlet 188 of the imaging device via internal toner outlet 11510, the intermediate toner outlet 1800, and the external toner outlet 11520.

One end of the inner cylinder 1151 is connected with the toner transfer slot 112, and the other end is connected with the toner-outlet switch 18. Thus, the toner in the inner cylinder 1151 can enter into the toner-outlet switch 18. To facilitate the toner in the toner-outlet switch 18 flows back into the inner cylinder 1151, when the toner-outlet switch 18 slides inside the toner cartridge, the inward chamfer 11512 is provided on the cylinder wall of the inner cylinder 1151, as shown in FIGS. 20*a* and 22. The chamfer 11512 can help guiding the toner in the toner-outlet switch 18 to the inner cylinder 1151.

Fifth Embodiment

The present embodiment proposes another exemplary toner cartridge. Unless specifically indicated, the structures described in this embodiment may be the same as those described in the above embodiments.

Referring FIGS. 25-28, the toner transport portion 115 is provided with a hollow outer cylinder 1152, and one end of the toner feeding auger 16 extends into the outer cylinder 1152. The outer cylinder 1152 has an external toner outlet 11520 on its peripheral wall in the direction towards the bottom of the toner cartridge, and a toner-outlet switch 24 is disposed on the outer wall at the bottom of the outer cylinder 1152. The toner-outlet switch 24 has a sliding plate structure and can slide outside the toner transport portion 115.

More particularly, a receiving portion 1153 is disposed at the bottom outer wall of the outer cylinder 1152, covering the external toner outlet 11520. Two guide slots 1154 are disposed at the bottom of the receiving portion 1153, a recess 1155 is located at the middle of the bottom of the receiving portion 1153 and connected with the two guide slots 1154. The guide slots 1154 are arranged in parallel to the longitude direction of the toner cartridge.

Both the recess 1155 and the two guide slots 1154 can fittingly match the toner-outlet switch 24, such that the toner-outlet switch 24 can slides or translate in the receiving portion 1153 along the longitudinal direction of the toner cartridge.

Figure 29:
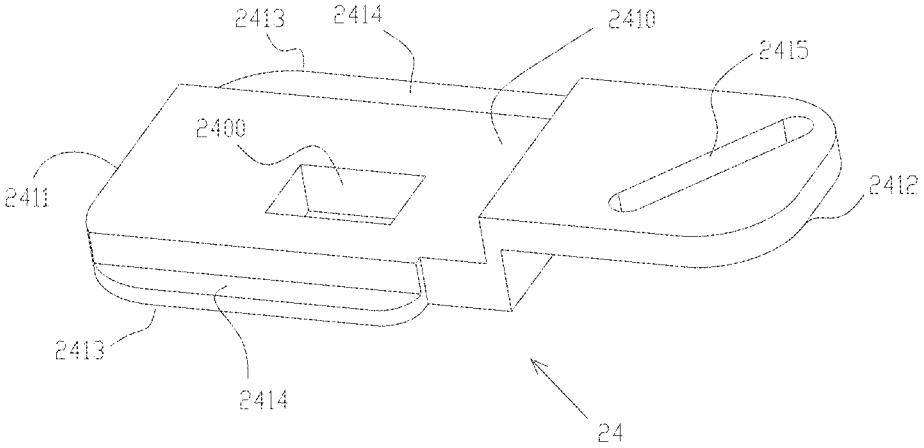
FIG. 29 is a perspective view of a toner outlet switch according to disclosed embodiments.

As shown in FIG. 29, the toner-outlet switch 24 is a sliding plate structure and includes a body 2410 and an intermediate toner outlet 2400 disposed on the body 2410. The body 2410 may be a plate-shaped structure with a bent member, including a free end 2411, a connecting end 2412, and two side ends 2413. The free end 2411 can be inserted into the receiving portion 1153. The two side ends 2413 of the body 2410 each extends to a sliding portion 2414, and the two sliding portions 2414 are used to fit in the two guide slots 1154 at the bottom of the outer cylinder 1152, such that the body 2410 can be fit into the recess 1155 of the receiving portion 1153 and can slide in the receiving portion 1153.

Further, a force receiving portion 2415 is provided on the connecting end 2412. For example, the force receiving portion 2415 is a long slant groove on the plane of the body 2410, and is used to receive a driving force for the toner-outlet switch 24 to slide.

Figure 27:
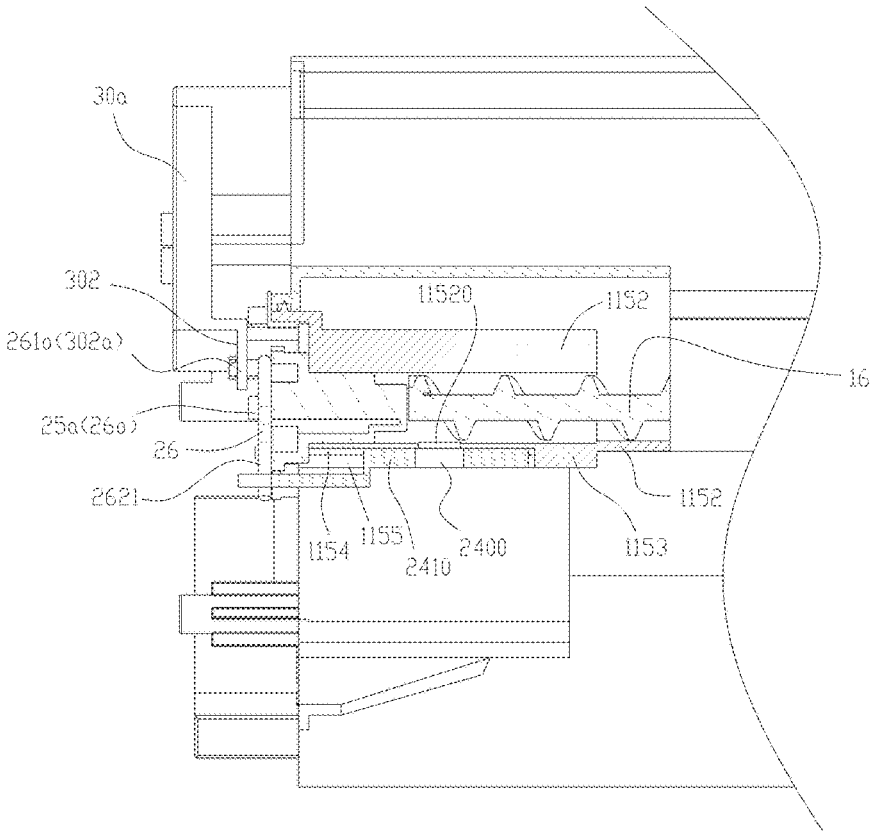
FIG. 27 is a cross-sectional schematic view of a toner outlet switch in an open state according to disclosed embodiments.
Figure 28:
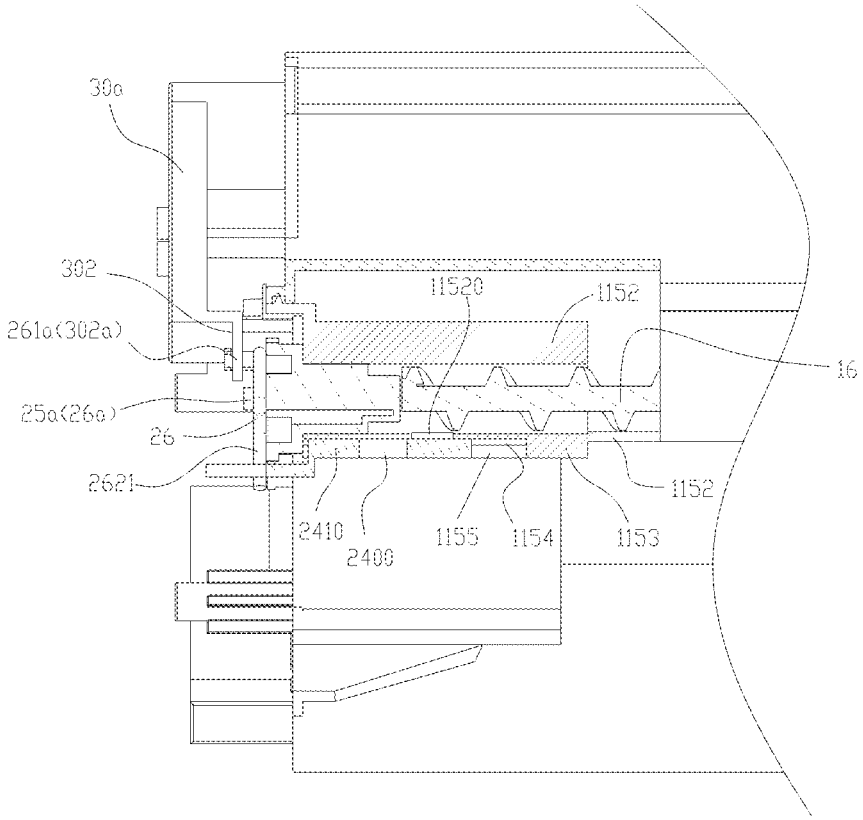
FIG. 28 is a cross-sectional schematic view of a toner outlet switch in a closed state according to disclosed embodiments.

Referring to FIGS. 27 and 28, when the external toner outlet 11520 and the intermediate toner outlet 2400 are aligned, the toner-outlet switch 24 is in a first position (FIG. 27), i.e., the toner can flow into the imaging device from the toner cartridge through the toner outlets, an open position. When the intermediate toner outlet 2400 is staggered with the external toner outlet 11520, the toner-outlet switch 24 is in a second position (FIG. 28), i.e., the toner cannot flow into the imaging device from the toner cartridge, a closed position.

Figure 25:
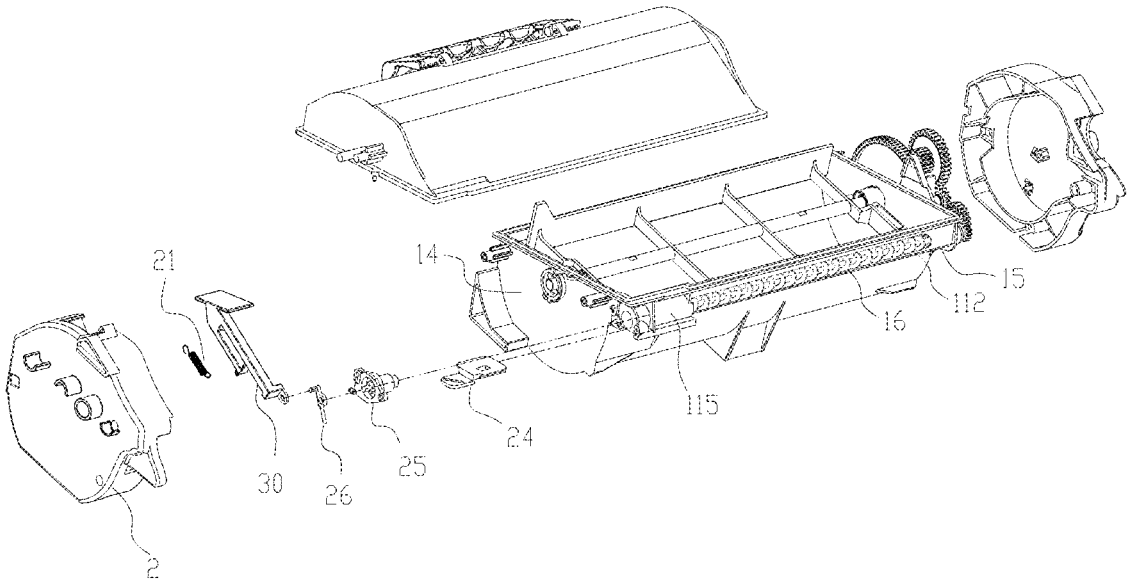
FIG. 25 is an exploded view of a toner cartridge according to disclosed embodiments.
Figure 26:
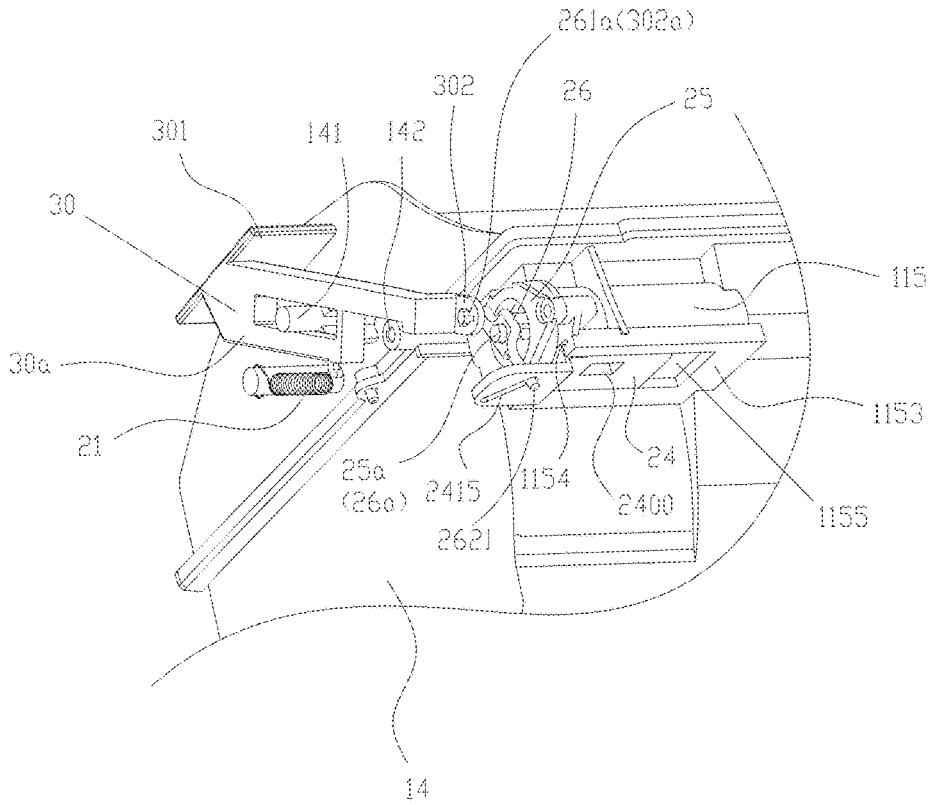
FIG. 26 is a partial schematic diagram of the toner cartridges at a first sidewall according to disclosed embodiments.
Figure 30:
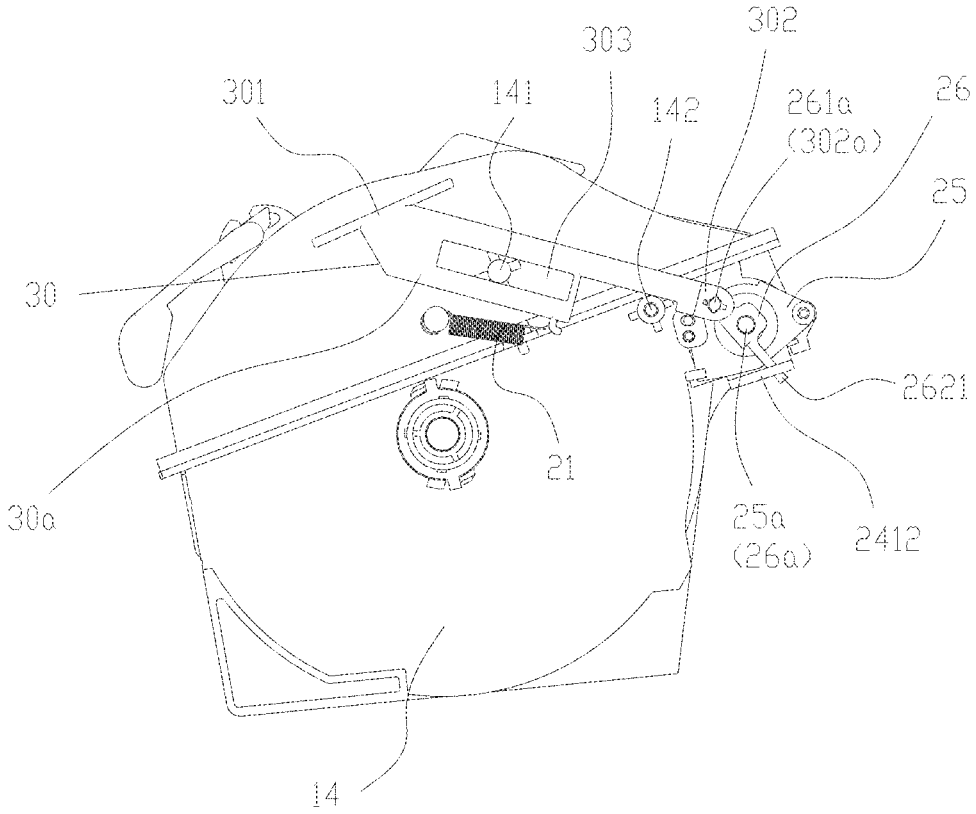
FIG. 30 is a left side view of the toner cartridge with the first side cover removed according to disclosed embodiments.

As shown in FIGS. 25, 26, and 30, the disclosed driving structure includes a pressing member 30 and a rotating member 26 disposed between the first side cover 2 and the first sidewall 14. The pressing member 30 and the rotating member 26 can be used to push the toner-outlet switch 24 to cause the toner-outlet switch 24 to slide in the receiving portion 1153 outside the toner transport portion 115.

The rotating member 26 includes a rotating shaft hole 26*a*, and a receiving rod 261 and a transmission rod 262 located at two sides of the rotating shaft hole 26*a*, respectively. The rotating member 26 can rotate freely along the axis of the rotating shaft hole 26*a*. The pressing member 30 includes a pressing body 30*a*, one end of the pressing body 30*a* is provided with a pushing portion 301, and the other end is provided with a power transfer portion 302. The pushing portion 301 contacts the pushing device in the printer to receive a pushing force or a thrust. The power transfer portion 302 engages the receiving rod 261 of the rotating member 26 to transfer the thrust, and the transmission rod 262 of the rotating member 26 further transfer the thrust to the toner-outlet switch 24, causing the toner-outlet switch 24 to slide.

In certain embodiments, the power transfer portion 302 includes a shaft hole 302*a*. The receiving rod 261 of the rotating member 26 includes a cylinder 261*a* extending along the rotatory axis of the rotating member 26. The cylinder 261*a* can be fittingly inserted in the shaft hole 302*a*, such that the power transfer portion 302 can push the rotating member 26 to rotate freely. At the same time, the transmission rod 262 of the rotating member 26 extends into the force receiving portion 2415 of the toner-outlet switch 24.

Because the force receiving portion 2415 is a slant elongated guide slot on a plane surface, when the rotating member 26 rotates, the transmission rod 262 swings in the force receiving portion 2415, forcing the force receiving portion 2415 to move along its slant direction. Thus, the movement of the force receiving portion 2415 cause the entire toner-outlet switch 24 to slide in the receiving portion 1153 along the two guide slots 1154. As the pressing member 30 drives the rotating member 26 to rotate in a forward direction or a reverse direction, the toner-outlet switch 24 is pushed to slide back and forth along the longitudinal direction of the toner cartridge, achieving the switch between the first position and the second position.

The pressing body 30*a* is rotatably and slidably connected to the first sidewall 14, and the slidable connection may include one or more fixed rod or fixed block engaged with a slide groove, or engaged guide rail/guide slot, etc. For example, to connect the pressing member 30 and the housing of the toner cartridge, the pressing body 30*a* has an elongated guide slot 303 in the middle of the pressing body 30*a*, and the guide slot 303 matches one guide rail protrusions 141 on the first sidewall 14. Another guide rail protrusions 141 on the first sidewall 14 abuts the pressing member body outside the guide slot 303. That is, being supported and restrained by the guide rail protrusions 141 inserted in the guide slot 303 and the guide rail protrusions 141 outside the guide slot 303, the guide slot 303 can be guided by the guide rail protrusions 141 to slide, and also can rotate using the guide rail protrusions 141 as the pivotal point, causing the pressing member 300 to rotate and slide relative to the sidewall 14 of the toner cartridge.

The driving structure may also include an external elastic member 21. Similar to the Third Embodiment, one end of the elastic member 21 is connected with the pressing member 30, and the other end is connected with the sidewall 14. Using the elastic restoring force of the external elastic member 21, the pressing member 30 can be sliding back to the initial position after pressing the toner-outlet switch 24.

The rotating member 26 may be fastened on the first sidewall 14 by an axial positioning member 25. The axial positioning member 25 is fixed to the first sidewall 14, and a positioning pillar 25*a* is disposed in the middle part of the axial positioning member 25. Thus, the rotating shaft hole 26*a* of the rotating member 26 can couple the positioning pillar 25*a* for positioning and rotating.

Figure 31:
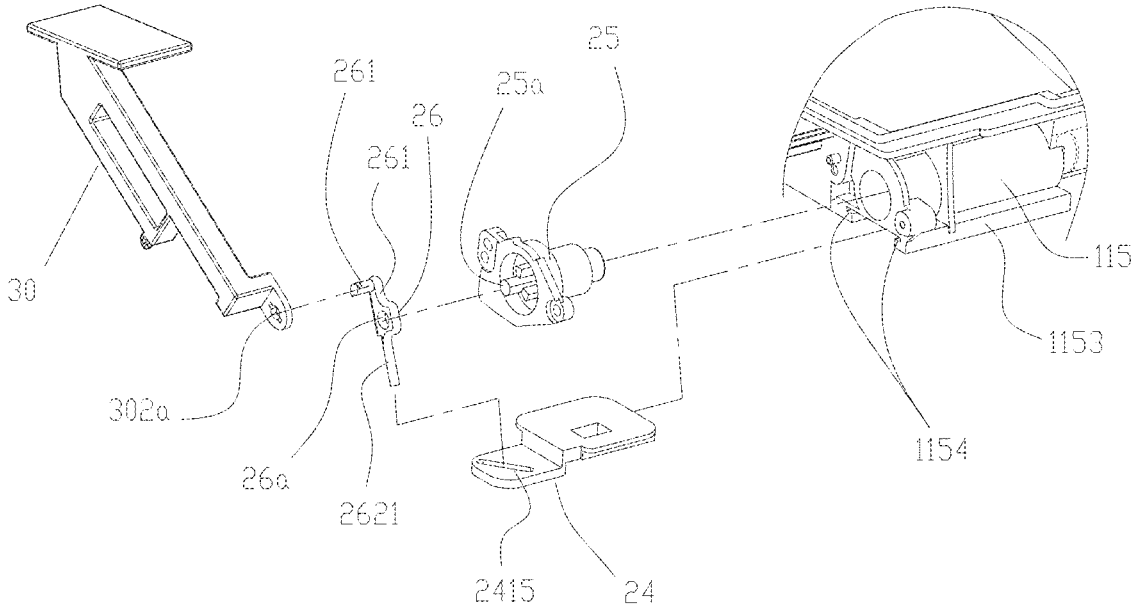
FIG. 31 is a schematic assembly diagram of a driving device and a toner outlet switch according to disclosed embodiments.

The axial positioning of the rotating member 26 can be achieved by providing a protrusion on the outer end of the cylinder 261*a* to abut or block the outer surface of the shaft hole 302*a* of the axially positioned power transfer portion 302, or by providing a protrusion on the outer end of the positioning pillar 25*a* to abut or block the outer surface of the rotating shaft hole 26*a*, so as to prevent the rotating member 26 from being out of place during rotation. With the restraint of the elongated guide slot of the force receiving portion 2415, the axial positioning of the toner-outlet switch 24 can also be controlled, as shown in FIGS. 30 and 31.

The sliding direction of the toner-outlet switch 24 is perpendicular to the sliding direction of the pressing member 30 and the rotary plane of the rotating member 26, the sliding movement of the pressing member 30 is converted to the translational movement of the toner-outlet switch 24.

Sixth Embodiment

The present embodiment proposes another exemplary toner cartridge. Unless specifically indicated, the structures described in this embodiment may be the same as those described in the above embodiments.

Referring to FIGS. 32-35, the toner transport portion 115 is provided with a hollow outer cylinder 1152, and one end of the toner feeding auger 16 extends into the outer cylinder 1152. The outer cylinder 1152 has an external toner outlet 11520 on its peripheral wall in the direction towards the bottom of the toner cartridge, and a toner-outlet switch 27 is disposed on the outer wall at the bottom of the outer cylinder 1152. The toner-outlet switch 27 has a sliding plate structure and can slide outside the toner transport portion 115.

More particularly, a receiving portion 1156 is disposed at the bottom outer wall of the outer cylinder 1152, covering the external toner outlet 11520. Two guide slots 1157 are disposed at the bottom of the receiving portion 1156, a recess 1158 is located at the middle of the bottom of the receiving portion 1156 and connected with the two guide slots 1157. The guide slots 1157 are arranged in parallel to the longitude direction of the toner cartridge.

Both the recess 1158 and the two guide slots 1157 can fittingly match the toner-outlet switch 27, such that the toner-outlet switch 27 can slide or translate in the receiving portion 1156 along the longitudinal direction of the toner cartridge.

Figure 36:
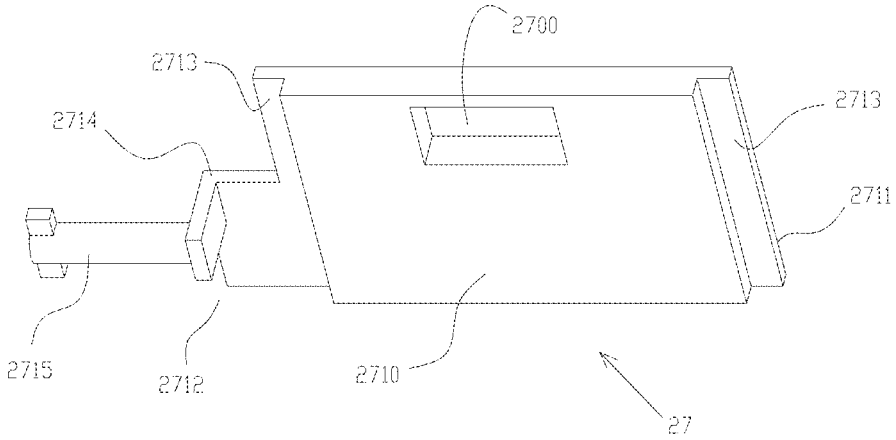
FIG. 36 is a perspective schematic diagram of the toner outlet switch according to disclosed embodiments.

As shown in FIG. 36, the toner-outlet switch 27 is a sliding plate structure and includes a body 2710 and an intermediate toner outlet 2700 disposed on the body 2710. The body 2710 may be a plate-shaped structure with a bent member, including a free end 2711 and a connecting end 2712. The free end 2711 and the connecting end 2712 each extends to a sliding portion 2713, and the two sliding portions 2713 are used to fit in the two guide slots 1157 at the bottom of the outer cylinder 1152, such that the body 2710 can be fit into the recess 1158 of the receiving portion 1156 and can slide in the receiving portion 1156.

Further, a force receiving portion 2715 is provided on the connecting end 2712. For example, the force receiving portion 2715 is a round bar extending parallel to the plane surface of body 2710, and is used to receive a driving force for the toner-outlet switch 27 to slide.

Figure 34:
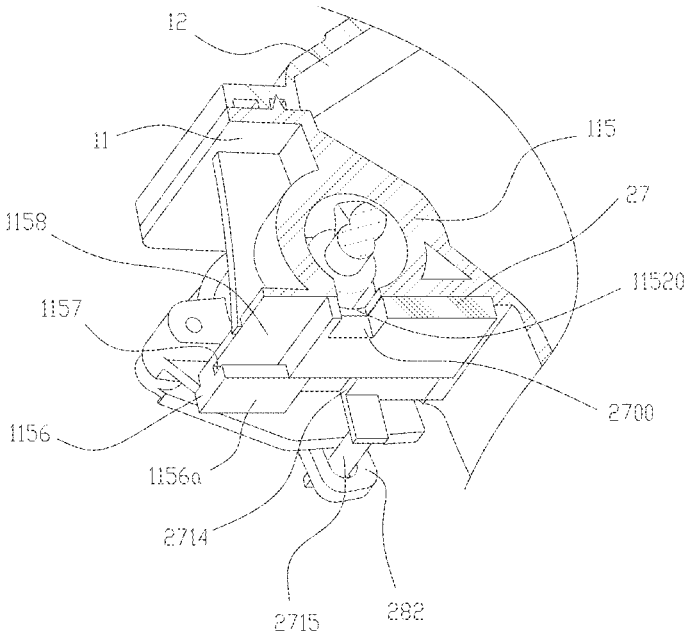
FIG. 34 is a cross-sectional view of a toner outlet switch in an open state according to disclosed embodiments.
Figure 35:
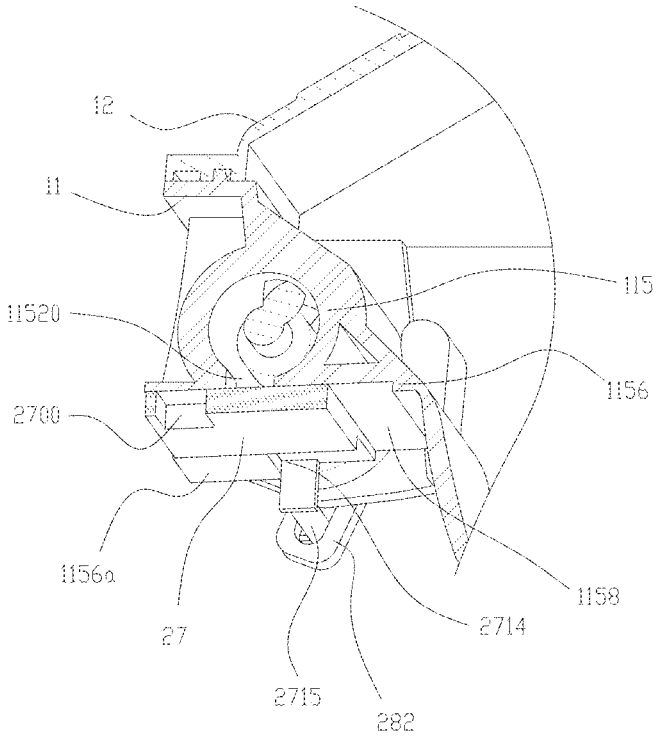
FIG. 35 is a cross-sectional view of a toner outlet switch in a closed state according to disclosed embodiments.

Referring to FIGS. 34 and 35, when the external toner outlet 11520 and the intermediate toner outlet 2700 are aligned, the toner-outlet switch 27 is in a first position (FIG. 34), i.e., the toner can flow into the imaging device from the toner cartridge through the toner outlets, an open position. When the intermediate toner outlet 2700 is staggered with the external toner outlet 11520, the toner-outlet switch 27 is in a second position (FIG. 35), i.e., the toner cannot flow into the imaging device from the toner cartridge, a closed position.

Figure 32:
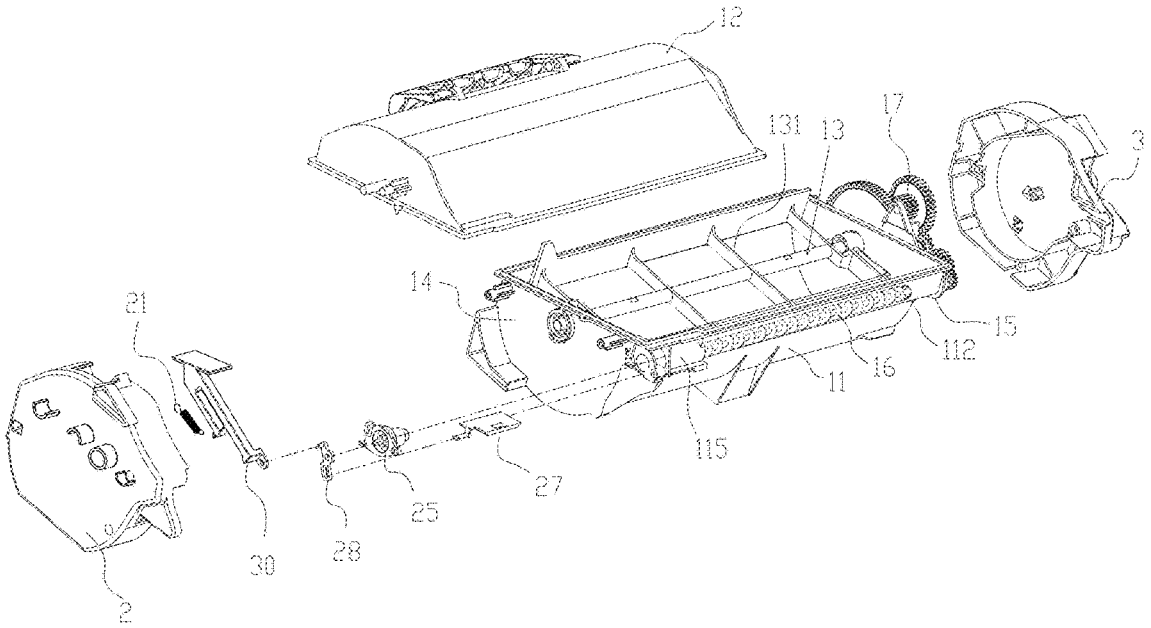
FIG. 32 is an exploded view of a toner cartridge according to disclosed embodiments.
Figure 33:
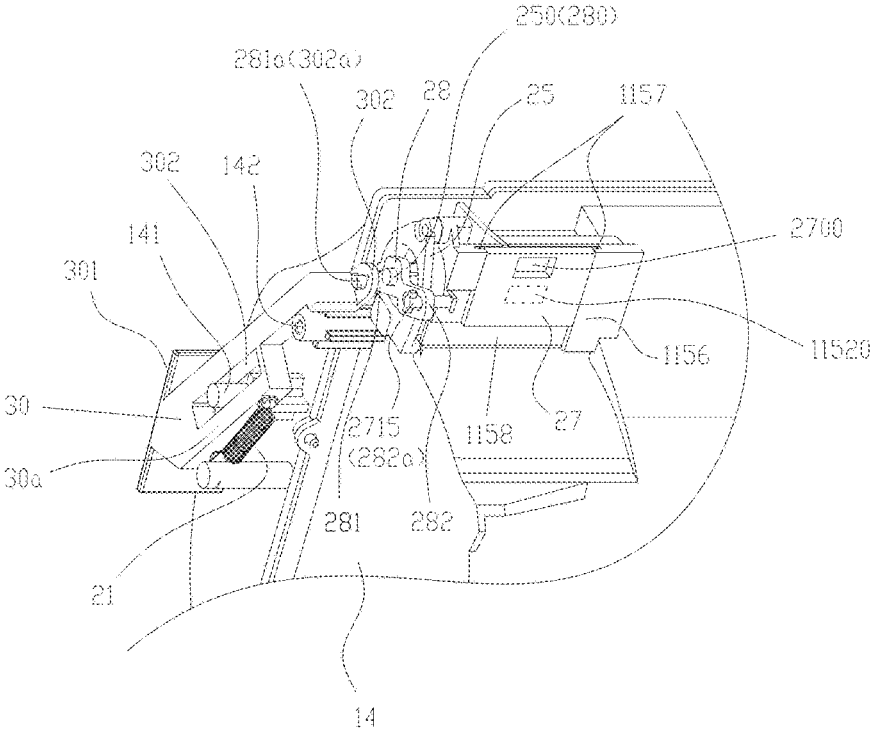
FIG. 33 is a partial schematic view of the toner cartridge at the first sidewall according to disclosed embodiments.

As shown in FIGS. 32, 33, and 36, the disclosed driving structure includes a pressing member 30 and a rotating member 28 disposed between the first side cover 2 and the first sidewall 14. The pressing member 30 and the rotating member 28 can be used to push the toner-outlet switch 27 to cause the toner-outlet switch 27 to slide in the receiving portion 1156 outside the toner transport portion 115.

The rotating member 28 includes a rotating shaft hole 280, and a receiving rod 281 and a transmission rod 282 located at two sides of the rotating shaft hole 280, respectively. The rotating member 28 can rotate freely along the axis of the rotating shaft hole 280. The pressing member 30 includes a pressing body 30*a*, one end of the pressing body 30*a* is provided with a pushing portion 301, and the other end is provided with a power transfer portion 302. The pushing portion 301 contacts the pushing device in the printer to receive a pushing force or a thrust. The power transfer portion 302 engages the receiving rod 281 of the rotating member 28 to transfer the thrust, and the transmission rod 282 of the rotating member 28 further transfer the thrust to the toner-outlet switch 27, causing the toner-outlet switch 27 to slide.

In certain embodiments, the power transfer portion 302 includes a shaft hole 302*a*. Similar to the Fifth Embodiment, the receiving rod 281 of the rotating member 28 includes a cylinder 281*a* extending along the rotatory axis of the rotating member 28. The cylinder 281*a* can be fittingly inserted in the shaft hole 302*a*, such that the power transfer portion 302 can push the rotating member 28 to rotate freely. At the same time, the transmission rod 282 of the rotating member 28 has an elongated guide slot 282*a*, and the force receiving portion 2715 of the toner-outlet switch 27 extends into the elongated guide slot 282*a*.

The force receiving portion 2715 swings in the elongated guide slot 282*a* of the transmission rod 282, forcing the force receiving portion 2715 to move along a slant direction of the elongated guide slot 282*a*. Thus, the elongated guide slot 282*a* of the transmission rod 282 provides a guiding function to cause the entire toner-outlet switch 27 to slide in the receiving portion 1156 along the two guide slots 1157. As the pressing member 30 drives the rotating member 28 to rotate in a forward direction or a reverse direction, the toner-outlet switch 27 is pushed to slide back and forth along the longitudinal direction of the toner cartridge, achieving the switch of the toner-outlet switch 27 between the first position and the second position.

The pressing body 30*a* is rotatably and slidably connected to the first sidewall 14, similar to the Third Embodiment. For example, being supported and restrained by the guide rail protrusions 141 inserted in the guide slot 303 and the guide rail protrusions 141 outside the guide slot 303, the guide slot 303 can be guided by the guide rail protrusions 141 to rotate using the guide rail protrusion 141 as the pivotal point, causing the pressing member 300 to rotate and slide relative to the sidewall 14 of the toner cartridge.

Further, similar to the Fifth Embodiment, the driving structure may also include an external elastic member 21. Using the elastic restoring force of the external elastic member 21, the pressing member 30 can be sliding back to the initial position after pressing the toner-outlet switch 27.

The rotating member 28 may be fastened on the first sidewall 14 by an axial positioning member 25, whose structure and axial positioning scheme may be similar to those described in the Fifth Embodiment. However, because the sliding direction of the toner-outlet switch 27 is perpendicular to the longitudinal direction of the toner cartridge, to effectively prevent the toner-outlet switch 27 from sliding out of the housing of the toner cartridge, a stopper portion 1156*a* may be provided on the receiving portion 1156, and a bent blocking portion 2714 may be provided on the toner-outlet switch 27. The blocking portion 2714 abuts the stopper portion 1156*a* to prevent the toner-outlet switch 27 from moving out in the direction perpendicular to the longitudinal direction of the toner cartridge, as shown in FIGS. 33 and 34.

Similarly, the sliding movement of the pressing member 30 is converted to the translational movement of the toner-outlet switch 24, and the translation direction of the toner-outlet switch 27 is perpendicular to the longitudinal direction of the toner cartridge and parallel to the rotary plane of the rotating member 26. Thus, it may be easy for the rotating member 26 to drive the toner-outlet switch 27 to slide or translate.

Seventh Embodiment

Figure 37:
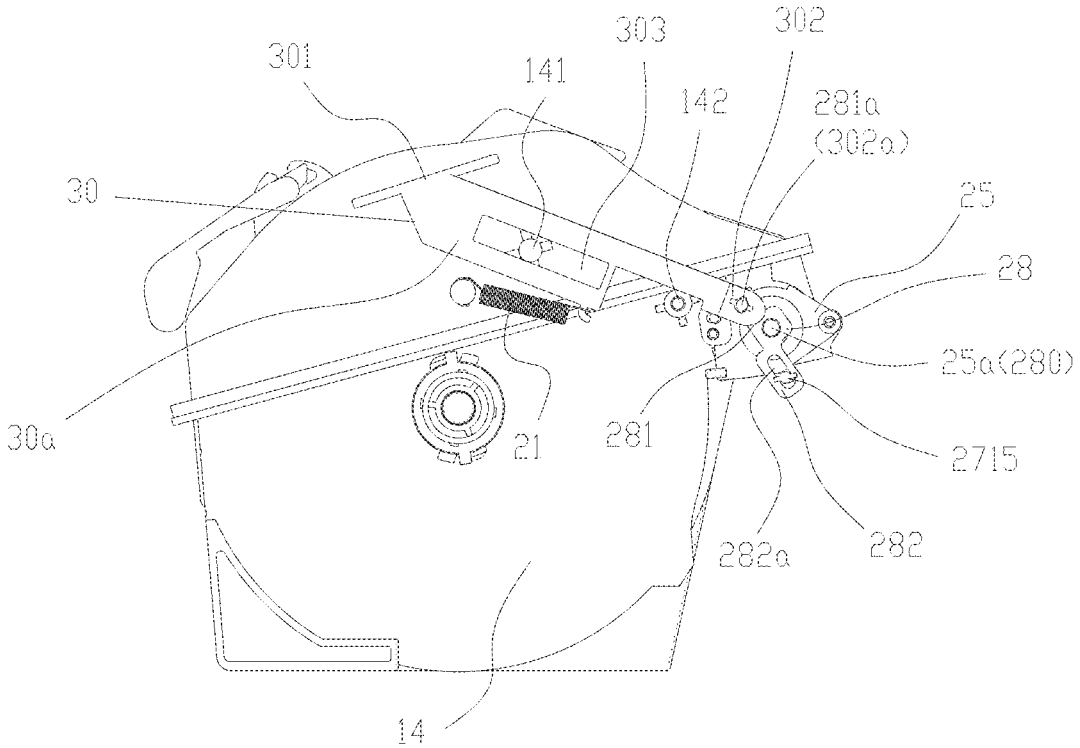
FIG. 37 is a left side view of the toner cartridge with the first side cover removed according to disclosed embodiments.
Figure 38:
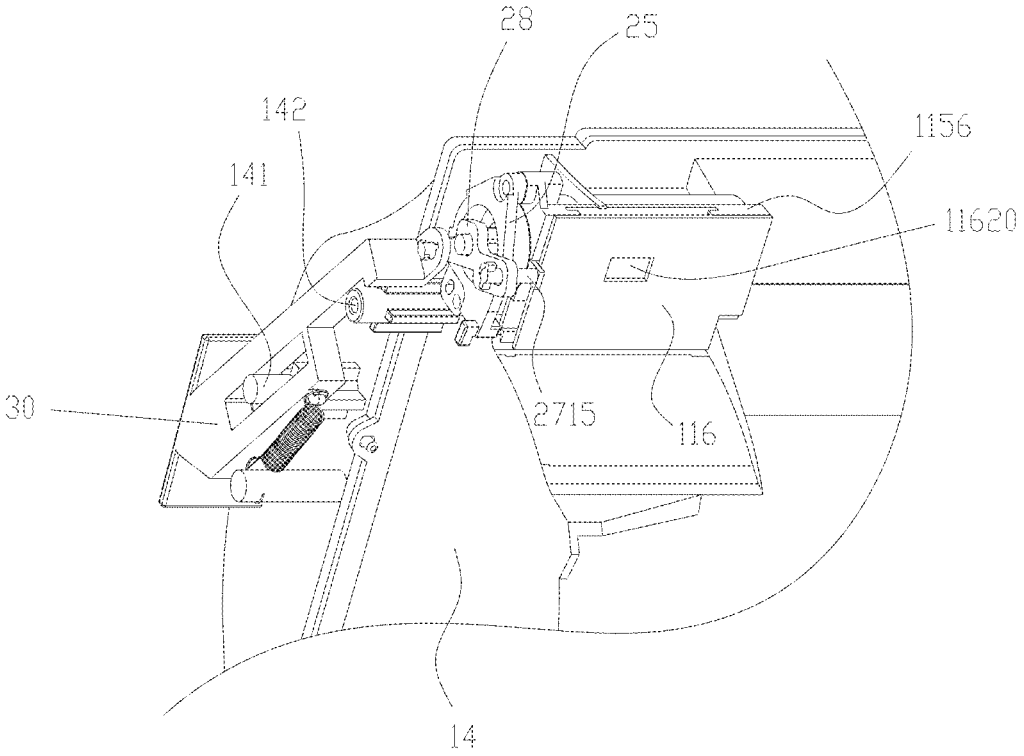
FIG. 38 is a partial schematic view of the toner cartridge at the first sidewall according to disclosed embodiments.

The present embodiment provides another exemplary toner cartridge structure. Based on the Sixth Embodiment, as shown in FIG. 37, a blocking portion 116 is added on the outer wall of the bottom of the toner transport portion 115, the toner-outlet switch 27 slides or translates between the receiving 1156 and the blocking portion 116. The blocking portion 116 has an overlapping toner outlet 11620. That is, the position of the overlapping toner outlet 11620 overlaps with the external toner outlet 11520.

Figure 39:
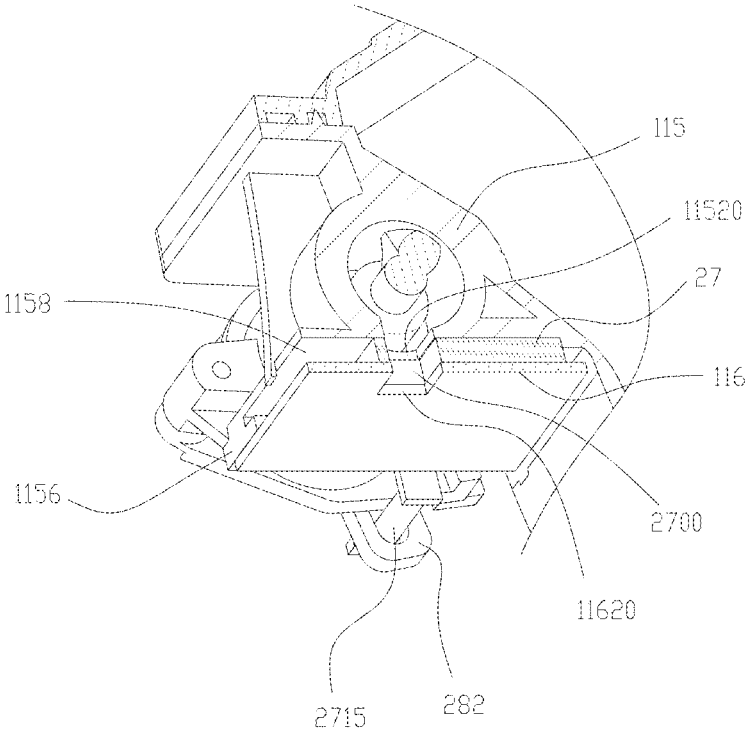
FIG. 39 is a cross-sectional view of another toner outlet switch in an open state according to disclosed embodiments.
Figure 40:
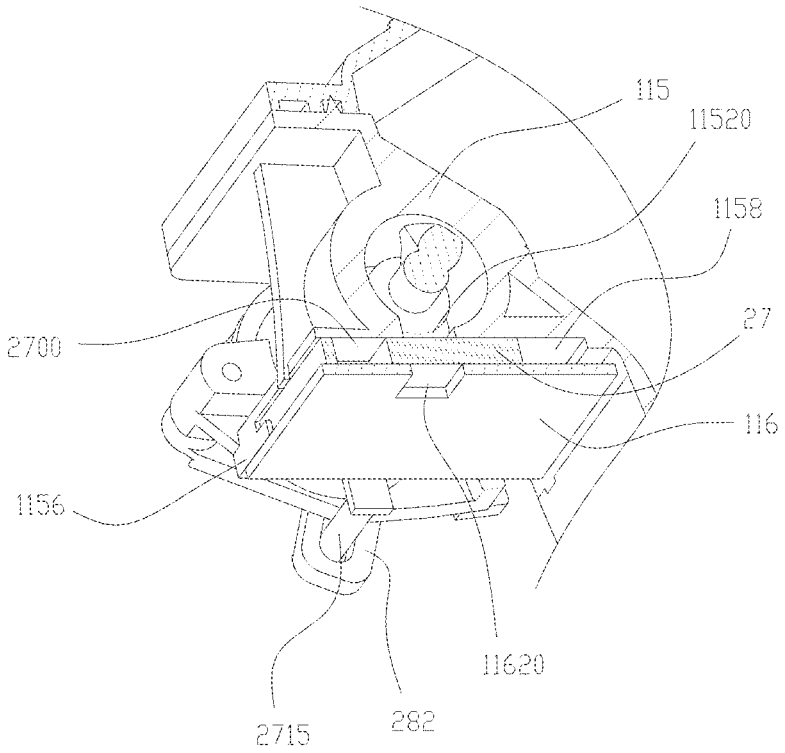
FIG. 40 is a cross-sectional view of another toner outlet switch in a closed state according to disclosed embodiments.

The toner-outlet switch 27 may have similar structure and sliding mechanism as in the Sixth Embodiment. Accordingly, the blocking portion 116 can be fixed on the bottom of the receiving portion 1156 after the toner-outlet switch 27 is installed by using adhesive or screw(s). By using the blocking portion 116, after the toner cartridge is installed in the printer, the toner-outlet switch 27 does not directly contact the toner inlet 188 of the imaging device, but slides between the receiving portion 1156 and the blocking portion 116 to reach the first position (the open position, as show in FIG. 39) or the second position (the closed position, as shown in FIG. 40). Thus, the toner-outlet switch 27 can slide more smoothly, avoiding the wear and tear of the sealing components on the surface of the toner inlet 188, such as sponge, due to the sliding friction.

Eighth Embodiment

Figure 41:
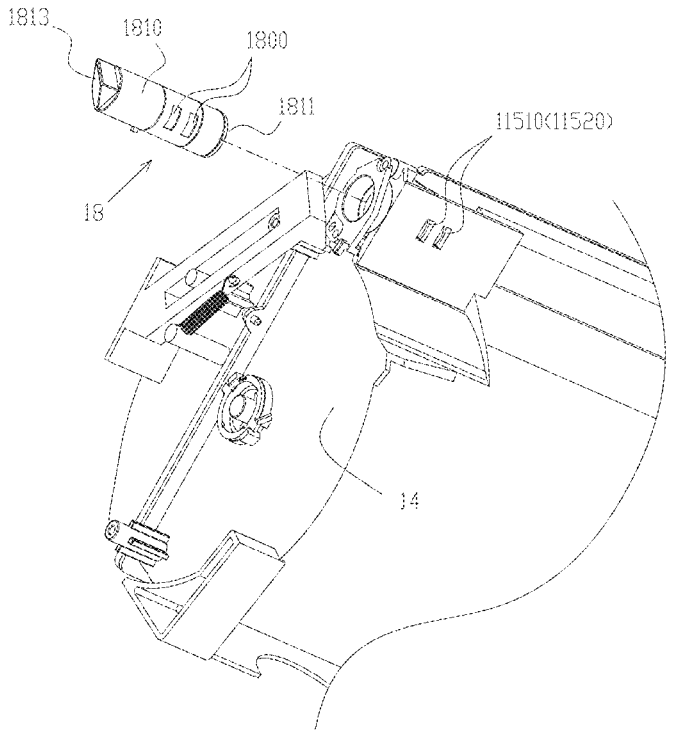
FIG. 41 is a partial schematic view of the toner cartridge at the first sidewall according to disclosed embodiments.
Figure 42:
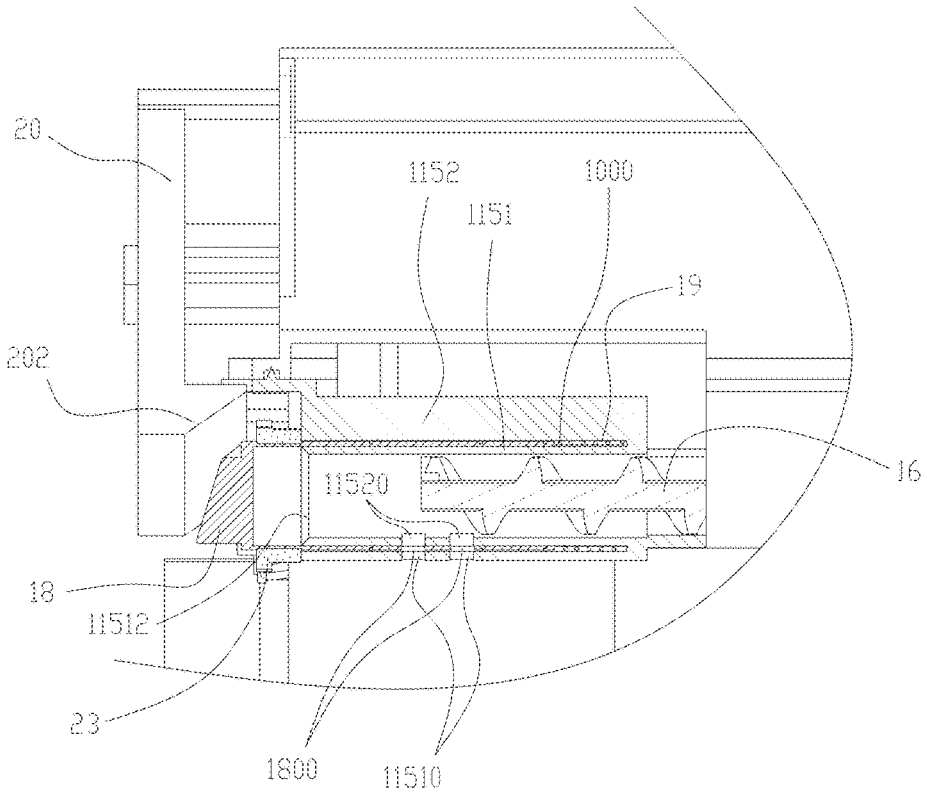
FIG. 42 is a cross-sectional view of another toner outlet switch in an open state according to disclosed embodiments.
Figure 43:
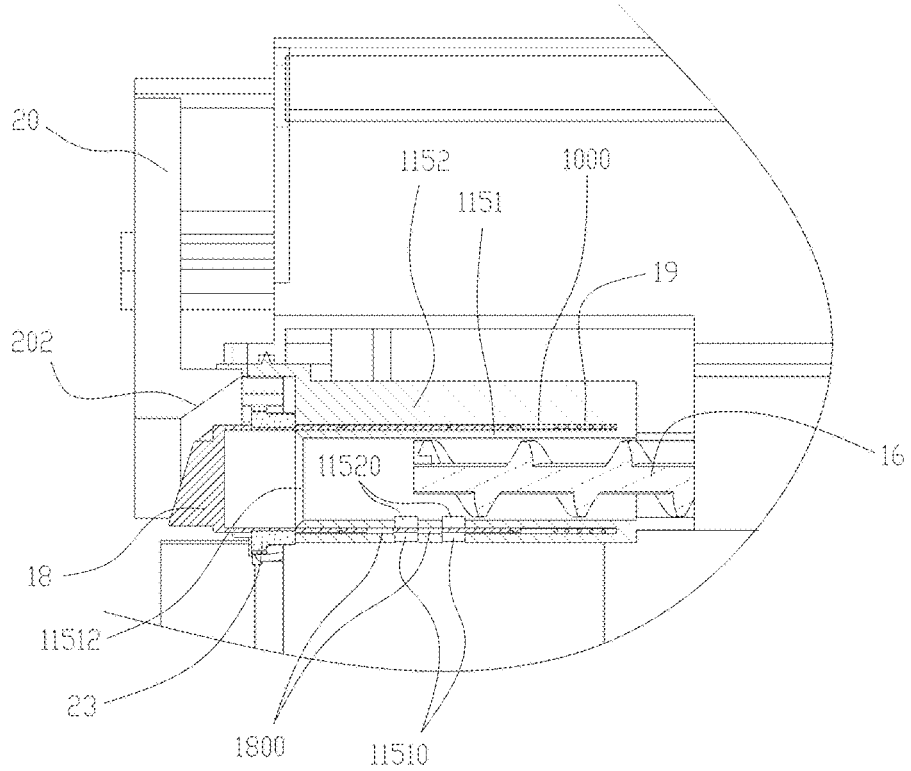
FIG. 43 is a cross-sectional view of another toner outlet switch in a closed state according to disclosed embodiments.

According to the present embodiment, the various toner outlet disclosed in the above embodiments may be configured as a grid structure. Using the Fourth Embodiment as an example, referring to FIG. 41, the inner cylinder 1151 has an internal toner outlet 11510, the outer cylinder 1152 has an external toner outlet 11520, and the toner-outlet switch 18 has an intermediate toner outlet 1800. These toner outlets may all have a double-door form of grid structure. The internal toner outlet 11510 and the external toner outlet 11520 are aligned and, with the sliding movement of the toner-outlet switch 18, the intermediate toner outlet 1800 can be aligned or staggered with the internal toner outlet 11510 and the external toner outlet 11520, as shown in FIGS. 42 and 43 (a first position and a second position). The distance between the aligned position and the staggered position is determined based on the size of each grid, not the total size of the toner outlet. Because the grid structure of the outlet, for the same opened area of the toner outlets, the sliding distance of the toner-outlet switch 18 can be reduced, reducing the force of the driving device and improving the efficiency of the toner outlet switch.

It should be noted that the above embodiments are merely provided for describing the technical solutions of the present invention, and not intended to limit the scope thereof. Although detailed descriptions are provided regarding the various embodiments, those skilled in the art can appreciate that the disclosed technical solutions can be modified, or some or all of the technical features can be equivalently replaced without inventive efforts. For example, the toner transport portion may be a non-enclosed cavity, or the power receiving portion and the power transfer portion may be using slant surface matching scheme to push the plate-structured toner-outlet switch to slide. Such modifications or replacements will be readily apparent to those skilled in the art, and do not depart from the spirit or scope of the invention.

What is claimed is:

1. A toner cartridge removably mounted on an imaging device, comprising:

a housing with a toner storage;

a cylindrical toner transport portion to transfer toner in the toner storage;

a toner outlet disposed on the cylindrical toner transport portion and aligned with a toner inlet on the imaging device; and a switch assembly matching the cylindrical toner transport portion and controlling the toner in the toner storage to flow from the toner outlet into the toner inlet; and a driving device coupled to the switch assembly to provide a driving force to slide the switch assembly in a direction of the driving force between a first position to open the toner outlet and a second position to close the toner outlet, wherein the driving device includes a pressing member disposed between a first side cover and a first sidewall of the toner cartridge to press the switch assembly under the driving force to slide between the first position and the second position, the sliding movement of the pressing member is converted to a sliding movement of the switch assembly, and a sliding direction of the switch assembly is perpendicular to a sliding direction of the pressing member.

2. The toner cartridge according to claim 1, wherein:

the pressing member includes a pressing body, one end of the pressing body is provided with a pushing portion, and the other end is provided with a power transfer portion;

the pushing portion receives the driving force from the imaging device; and the power transfer portion has an inclined surface matching with a force receiving portion of the switch assembly to transfer the driving force.

3. The toner cartridge according to claim 1, wherein:

the switch assembly includes an elastic member and a cylindrical switch member having an open end and a closed end;

a cylindrical toner transport portion includes an outer cylinder with the toner outlet;

the cylindrical switch member slides inside the outer cylinder of the cylindrical toner transport portion; and the elastic member is disposed between the switch member and the cylindrical toner transport portion, one end of the elastic member abuts an annular end surface of the open end of the switch member, and another end of the elastic member abuts an end wall on one side of an inner wall of the toner transport portion.

4. The toner cartridge according to claim 3, wherein:

the switch member has an intermediate toner outlet on its peripheral wall;

the intermediate toner outlet is aligned with the toner outlet on the outer cylinder and the toner inlet when in the first position; and the intermediate toner outlet is staggered with the toner outlet on the outer cylinder and the toner inlet when in the second position.

5. The toner cartridge according to claim 1, wherein:

the switch assembly includes an elastic member and a cylindrical switch member having an open end and a closed end;

the cylindrical toner transport portion includes an inner cylinder and an outer cylinder;

the toner outlet comprises an internal toner outlet on the inner cylinder and an external toner outlet on the outer cylinder overlapped with the internal toner outlet;

the cylindrical switch member slides between the inner cylinder and the outer cylinder of the cylindrical toner transport portion; and the elastic member is disposed between the switch member and the cylindrical toner transport portion, one end of the elastic member abuts an annular end surface of the open end of the switch member, and another end of the elastic member abuts an end wall on one side of an inner wall of the toner transport portion.

6. The toner cartridge according to claim 5, wherein:

the switch member has an intermediate toner outlet on its peripheral wall;

the intermediate toner outlet is aligned with the internal toner outlet on the inner cylinder, the external toner outlet on the outer cylinder, and the toner inlet when in the first position; and the intermediate toner outlet is staggered with the internal toner outlet on the inner cylinder, the external toner outlet on the outer cylinder, and the toner inlet when in the second position.

7. The toner cartridge according to claim 6, wherein:

the intermediate toner outlet, the internal toner outlet on the inner cylinder, and the external toner outlet on the outer cylinder are identical grid structures.

8. The toner cartridge according to claim 1, wherein:

the cylindrical toner transport portion includes an outer cylinder, and the toner outlet comprises an external toner outlet on a peripheral wall of the outer cylinder in a direction towards a bottom of the toner cartridge; and the switch assembly has a sliding plate structure including a plate-shaped body and an intermediate outlet disposed on the plate-shaped body, and slides outside the toner transport portion under the driving force between the first position where the external toner outlet and the intermediate toner outlet are aligned and the second position where the intermediate toner outlet is staggered with the external toner outlet.

9. The toner cartridge according to claim 8, wherein:

a receiving portion is disposed at bottom of an outer wall of the peripheral wall of the outer cylinder and covers the external toner outlet;

two guide slots are disposed at bottom of the receiving portion and arranged in parallel to the longitude direction of the toner cartridge; and a recess is located at middle of the bottom of the receiving portion and connected with the two guide slots.

10. The toner cartridge according to claim 9, wherein:

the recess and the two guide slots fittingly match a toner-outlet switch, such that the toner-outlet switch slides in the receiving portion along the longitudinal direction of the toner cartridge under the driving force.

11. The toner cartridge according to claim 10, wherein:

the plate-shaped body of the switch assembly includes a free end, a connecting end, and two side ends; the free end is inserted into the receiving portion; the two side ends each extends to a sliding portion; and the two sliding portions are used to fit in the two guide slots such that the plate-shaped body is fitted into the recess of the receiving portion and slides in the receiving portion.

12. The toner cartridge according to claim 9, wherein:

the driving device further includes a rotating member disposed between the first side cover and the first sidewall; and the pressing member and the rotating member are used to push a toner-outlet switch to cause the toner-outlet switch to slide in the receiving portion outside the toner transport portion.

13. The toner cartridge according to claim 9, wherein:

the driving device further includes an external elastic member;

one end of the elastic member is connected with the pressing member, and the other end is connected with the first sidewall such that, under an elastic restoring force of the external elastic member, the pressing member is sliding back to an initial position after pressing a toner-outlet switch.

14. A toner cartridge removably mounted on an imaging device, comprising:

a housing with a toner storage;

a cylindrical toner transport portion to transfer toner in the toner storage;

a toner outlet disposed on the cylindrical toner transport portion and aligned with a toner inlet on the imaging device; and a switch assembly matching the cylindrical toner transport portion and controlling the toner in the toner storage to flow from the toner outlet into the toner inlet; and a driving device coupled to the switch assembly to provide a driving force to slide the switch assembly between a first position to open the toner outlet and a second position to close the toner outlet, wherein the driving device includes a pressing member disposed between a first side cover and a first sidewall of the toner cartridge to press the switch assembly under the driving force to slide between the first position and the second position, wherein:

the switch assembly includes an elastic member and a cylindrical switch member;

the cylindrical switch member is a hollow cylinder having an open end and a closed end, and an intermediate toner outlet is disposed on a wall of the hollow cylinder; and the open end faces toward of a toner transfer slot, and one end of a toner feeding auger extends inside the cylindrical switch member through the open end.

15. The toner cartridge according to claim 14, wherein:

a power receiving unit having a slant surface is provided on the closed end to receive a driving force to slide the switch assembly along the cylindrical toner transport portion;

the elastic member is provided between the switch assembly and the toner transport portion, one end of the elastic member abuts an annular end surface of the open end of the switch member, and the other end of the elastic member abuts an end wall on one side of an inner wall of the toner transport portion.

16. The toner cartridge according to claim 15, wherein:

a gap is maintained between the switch member and the cylindrical toner transport portion such that the switch member slide smoothly along the cylindrical toner transport portion; and at least one sealing member is provided surrounding the switch member to prevent toner leakage.

17. The toner cartridge according to claim 14, wherein:

the pressing member includes a pressing body, one end of the pressing body is provided with a pushing portion, and the other end is provided with a power transfer portion;

the pushing portion receives the driving force from the imaging device; and the power transfer portion has an inclined surface matching with a force receiving portion of the switch assembly to transfer the driving force.

18. The toner cartridge according to claim 17, wherein:

a sliding direction of the switch assembly is perpendicular to a sliding direction of the pressing member; and the sliding movement of the pressing member is converted to a sliding movement of the switch assembly.

19. The toner cartridge according to claim 14, wherein:

the switch assembly includes an elastic member and a cylindrical switch member having an open end and a closed end;

a cylindrical toner transport portion includes an outer cylinder with the toner outlet;

the cylindrical switch member slides inside the outer cylinder of the cylindrical toner transport portion; and the elastic member is disposed between the switch member and the cylindrical toner transport portion, one end of the elastic member abuts an annular end surface of the open end of the switch member, and another end of the elastic member abuts an end wall on one side of an inner wall of the toner transport portion.

* * * * *